US007789690B1

(12) United States Patent
Rhein

(10) Patent No.: US 7,789,690 B1
(45) Date of Patent: Sep. 7, 2010

(54) CONNECTOR ASSEMBLY HAVING MULTI-STAGE LATCHING SEQUENCE

(75) Inventor: David James Rhein, Memphis, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/575,554

(22) Filed: Oct. 8, 2009

(51) Int. Cl.
*H01R 13/62* (2006.01)

(52) U.S. Cl. ..... 439/310; 439/352

(58) Field of Classification Search ..... 439/352, 439/310, 769, 806, 345
See application file for complete search history.

(56) References Cited

U.S. PATENT DOCUMENTS

| | | | | |
|---|---|---|---|---|
| 4,408,822 | A | 10/1983 | Nikitas | |
| 4,426,127 | A | 1/1984 | Kubota | |
| 5,417,579 | A * | 5/1995 | Yoshioka et al. | 439/310 |
| 5,545,049 | A * | 8/1996 | Hasegawa et al. | 439/310 |
| 5,575,675 | A * | 11/1996 | Endo et al. | 439/310 |
| 5,803,760 | A * | 9/1998 | Ito et al. | 439/310 |
| 5,873,737 | A * | 2/1999 | Hashizawa et al. | 439/39 |
| 6,123,569 | A * | 9/2000 | Fukushima et al. | 439/456 |
| 6,520,782 | B2 * | 2/2003 | Mori | 439/138 |
| 6,652,306 | B2 * | 11/2003 | Karamatsu et al. | 439/310 |

FOREIGN PATENT DOCUMENTS

| | | |
|---|---|---|
| DE | 19727453 | 1/1999 |
| GB | 2284510 | 6/1995 |

* cited by examiner

*Primary Examiner*—Michael C Zarroli

(57) ABSTRACT

A connector assembly includes a housing, a power supply contact, an interlock circuit contact, a lever subassembly and a lever latch. The lever subassembly is pivotally coupled to the housing and includes a handle and a gripping end that engages the mating connector to move the housing relative to the mating connector when the handle is rotated. The handle is rotated to sequentially decouple the interlock circuit contact from the mating interlock contact prior to unmating the power supply contact from the mating power contact. The lever latch is coupled with the housing and prevents unmating of the power supply contact from the mating power contact before separation of the interlock circuit contact and the mating interlock contact before the power supply contact is decoupled from the mating power contact and after the interlock circuit contact is decoupled from the mating interlock contact by blocking rotation of the lever subassembly.

20 Claims, 15 Drawing Sheets

CONNECTOR ASSEMBLY HAVING MULTI-STAGE LATCHING SEQUENCE

BACKGROUND OF THE INVENTION

The present invention relates to a connector assembly, and more particularly, to a connector assembly having mating connector assemblies for use in high voltage applications.

Increased fuel costs and increased efforts at reducing environmental pollution have lead the automotive industry towards electric and hybrid electric vehicles (HEV). One design aspect of these vehicles is the consideration for the high operating voltage. Consequently, specific components of the vehicles must be designed to accommodate the high voltage. The electrical assemblies of these vehicles include components that operate at high voltages and require high voltage pathways including connectors. For example, some known electrical vehicular assemblies include components that operate using up to 600 volts.

In connector applications that use high voltage, special requirements exist for providing safety to users and to prevent damage to other assembly components and the connectors themselves. For example, if a connector is unmated under active high voltage power, at the instant the mating conductors of the high voltage connector disconnect, the high voltage power may cause severe damage to the connector. Consequently, in some applications, a high-voltage interlock (HVIL) circuit is used to protect the connectors and other assembly components from damage due to the high voltage power. An HVIL circuit controls the high voltage power so that the high voltage power is not active at the mating and unmating of the high voltage conductors. In an HVIL circuit, the sequence of mating and unmating the high voltage conductors and the mating and unmating of the HVIL contacts is controlled to prevent injury to users or damage to the components. For example, an HVIL circuit may ensure that the high voltage conductors are mated prior to the HVIL contacts and thus prior to activating the high voltage power and, the HVIL contacts are unmated, which deactivates the high voltage power, prior to (and after a preferred delay) the unmating of the high voltage conductors.

Connectors used in these applications, must provide a stable, sealed mechanical and electrical connection between a high voltage connector and a metallic module, the proper shunted HVIL, shielding continuity from the connector to the metallic housing and must provide a touch safe condition when the connectors are unmated. One problem is that the integration of an HVIL protection circuit with a high voltage connector usually requires a second connector or does not provide significant delay during the unmating sequence.

BRIEF DESCRIPTION OF THE INVENTION

In one embodiment, a connector assembly is provided. The connector assembly includes a housing, a power supply contact, an interlock circuit contact, a lever subassembly and a lever latch. The housing includes a mating face configured to mate with a mating connector assembly. The power supply contact is disposed within the housing and is configured to mate with a mating power contact in the mating connector assembly. The interlock circuit contact is disposed within the housing and is configured to mate with a mating interlock contact in the mating connector assembly to control transfer of the electric power through the power supply contact. The lever subassembly is pivotally coupled to the housing and includes a handle and a gripping end that engages the mating connector to move the housing relative to the mating connector when the handle is rotated. The handle is rotated to sequentially decouple the interlock circuit contact from the mating interlock contact prior to unmating the power supply contact from the mating power contact. The lever latch is coupled with the housing and prevents unmating of the power supply contact from the mating power contact before separation of the interlock circuit contact and the mating interlock contact before the power supply contact is decoupled from the mating power contact and after the interlock circuit contact is decoupled from the mating interlock contact by blocking rotation of the lever subassembly.

In another embodiment, another connector assembly is provided. The connector assembly includes a housing, a power supply contact, an interlock circuit contact, a lever subassembly, and a slide bar. The housing has a mating face that is configured to mate with a mating connector. The power supply contact is disposed within the housing and is configured to mate with a mating power contact in the mating connector. The interlock circuit contact is disposed within the housing and is configured to mate with a mating interlock contact in the mating connector to control transfer of the electric power through the power supply contact. The lever subassembly is pivotally coupled to the housing and includes a handle and a gripping end that engages the mating connector to move the housing relative to the mating connector when the handle is rotated. The handle is rotated away from the mating face to sequentially unmate the interlock circuit contact from the mating interlock contact prior to unmating the power supply contact from the mating power contact. The slide bar is coupled to the handle and is slidably joined to the housing such that rotation of the handle linearly moves the slide bar relative to the housing. The slide bar prevents unmating of the power supply contact from the mating power contact before separation of the interlock circuit contact and the mating interlock before the power supply contact is unmated from the mating power contact and after the interlock circuit contact is unmated from the mating interlock contact.

In another embodiment, another connector assembly is provided. The connector assembly includes a housing, a power supply contact, an interlock circuit contact, a lever subassembly, and a toggle switch. The housing has a mating face configured to mate with a mating connector. The power supply contact is disposed within the housing and is configured to mate with a mating power contact in the mating connector. The interlock circuit contact is disposed within the housing and is configured to mate with a mating interlock contact in the mating connector to control transfer of the electric power through the power supply contact. The lever subassembly is pivotally coupled to the housing and includes a handle and a gripping end that engages the mating connector to move the housing relative to the mating connector when the handle is rotated. The handle is rotated away from the mating face to sequentially unmate the interlock circuit contact from the mating interlock contact prior to unmating the power supply contact from the mating power contact. The toggle switch is pivotally coupled with the housing and prevents unmating of the power supply contact from the mating power contact before separation of the interlock circuit contact and the mating interlock contact before the power supply contact is unmated from the mating power contact and after the interlock circuit contact is unmated from the mating interlock contact.

DETAILED DESCRIPTION OF THE INVENTION

Figure 1:
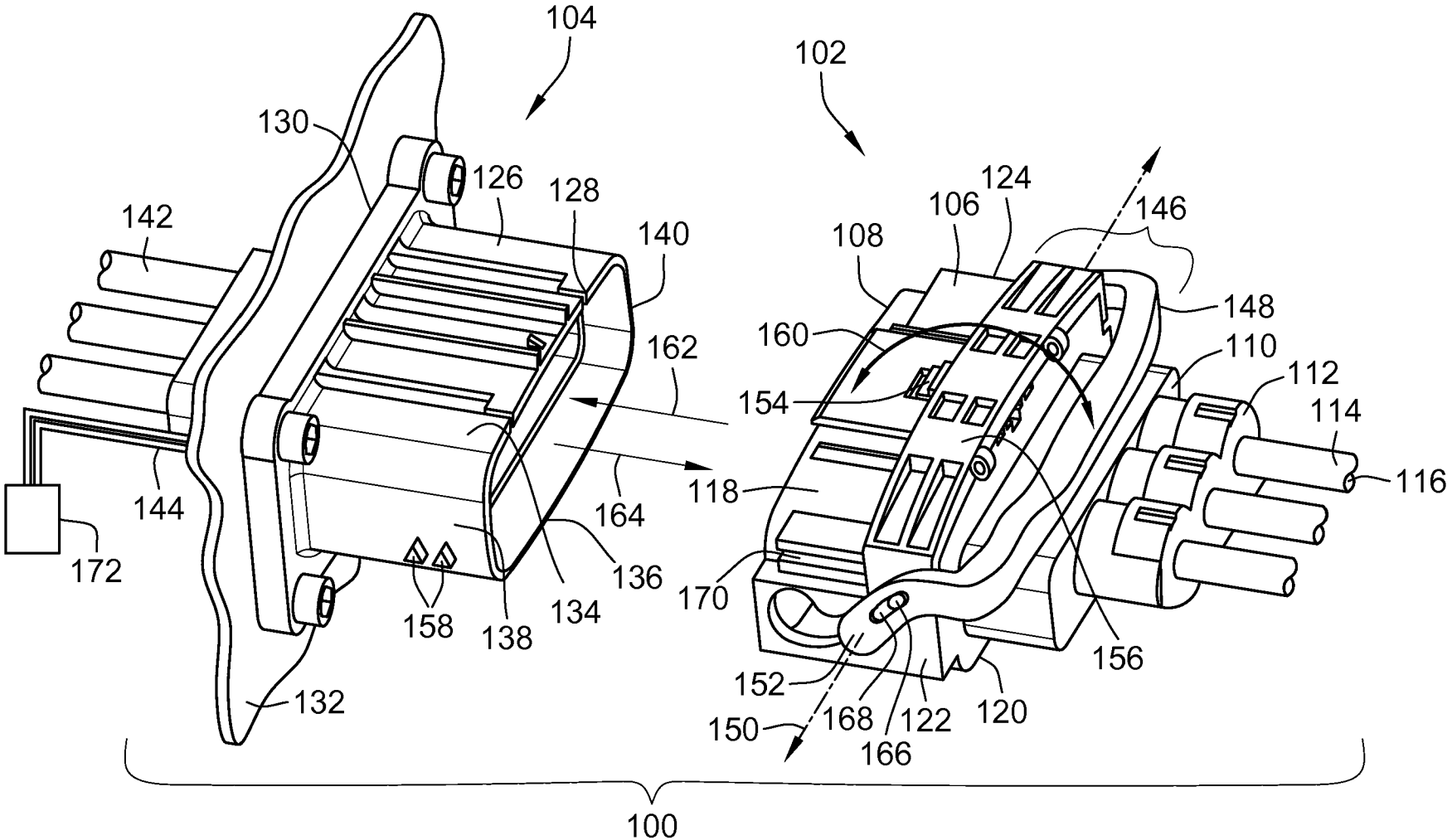
FIG. 1 is a perspective view of an unmated connector assembly in accordance with one embodiment of the present disclosure.
Figure 2:
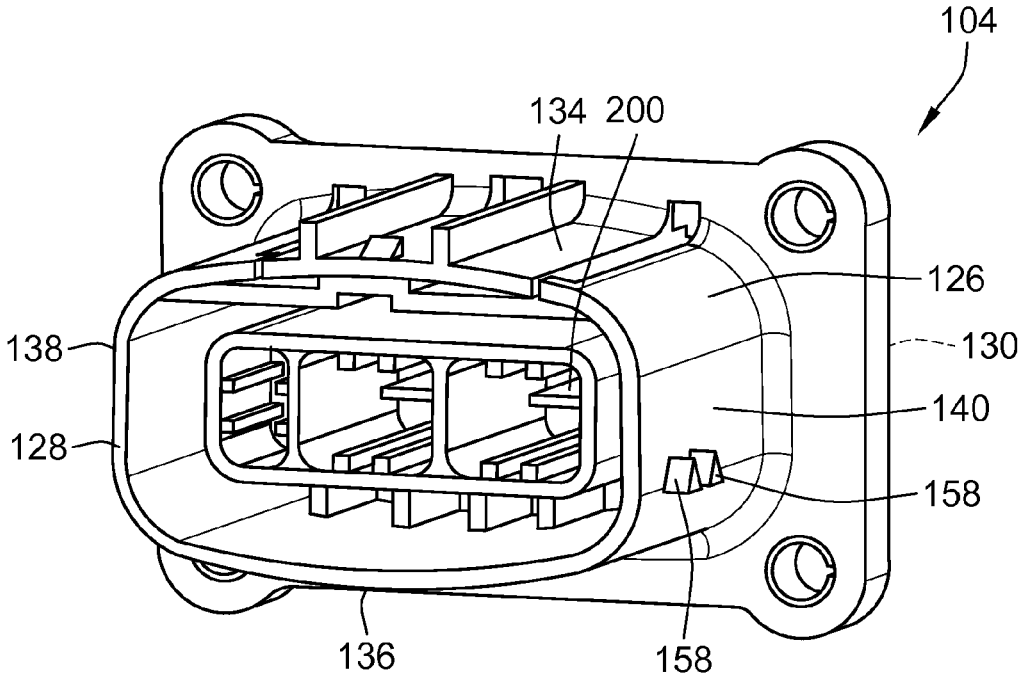
FIG. 2 is a perspective view of a mating connector assembly of the connector assembly shown in FIG. 1.
Figure 3:
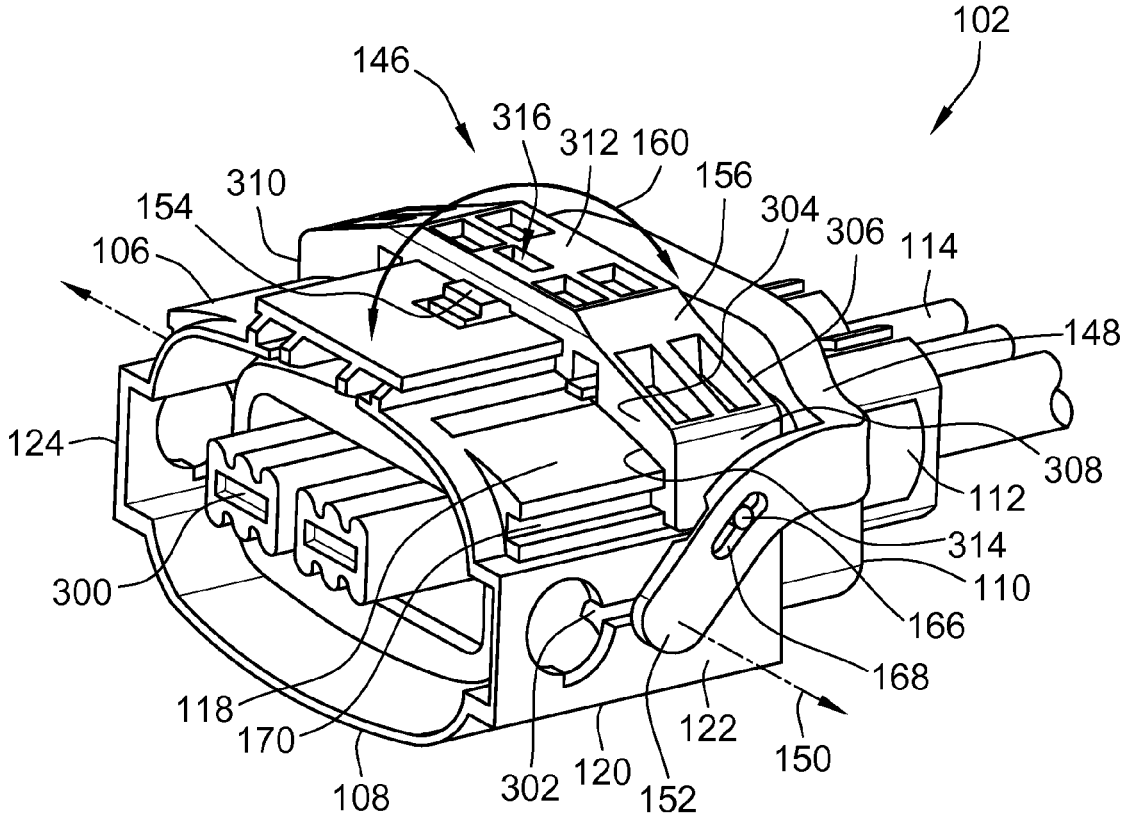
FIG. 3 is a perspective view of a connector assembly of the connector assembly shown in FIG. 1.

FIG. 1 is a perspective view of an unmated connector assembly 100 in accordance with one embodiment of the present disclosure. FIG. 2 is a perspective view of a header connector assembly 104 of the connector assembly 100 shown in FIG. 1. FIG. 3 is a perspective view of a mating connector assembly 102 of the connector assembly 100 shown in FIG. 1. The connector assembly 100 is a high voltage connector assembly in one embodiment. For example, the connector assembly 100 may be capable of transferring electric power or current at a voltage up to approximately 600 volts. The connector assembly 100 may transfer current at voltages of at least approximately 42 volts. Alternatively, the connector assembly 100 may be a assembly that transfers electric current at a lesser voltage. The connector assembly 100 may be a vehicular connector assembly. For example, the connector assembly 100 may be used to transfer electric current between two or more electronic devices or modules in an automobile.

The connector assembly 100 includes the mating connector assembly 102 and the header connector assembly 104. The connector assembly 102 and mating connector assembly 104 mate with one another to transfer electric power therebetween. The mating connector assembly 104 may be mounted to a module such as a metallic module (not shown) in an automotive high voltage application. By way of example only, the mating connector assembly 104 may be mounted to an exterior surface of a power distribution module 2300 (shown in FIG. 23) of an automobile that serves as a power source to one or more electronic devices, such as air conditioning or heating units. Alternatively, the mating connector assembly 104 may be a connector that is not mounted to a module. For example, the mating connector assembly 104 may be a connector that is configured to mate with the connector assembly 102 without being mounted to a module.

The connector assembly 102 includes an outer housing 106 that longitudinally extends between a mating face or end 108 and a rear side 110. The housing 106 also extends between a top side 118 and an opposite bottom side 120 and between opposite sides 122, 124. The mating face 108 engages and mates with the mating connector assembly 104 to couple the connector assembly 102 with the mating connector assembly 104. In the illustrated embodiment, the rear side 110 includes several cable ports 112. The cable ports 112 provide openings into the housing 106 into which several cables 114 extend. The cables 114 are electrically coupled with contacts disposed within the housing 106. For example, the cables 114 may include conductors 116 (shown in FIG. 1) that are electrically joined with power supply contacts 300 (shown in FIG. 3). The power supply contacts 300 mate with corresponding mating power contacts 200 (shown in FIG. 2) in the mating connector assembly 104 to provide an electrically communicative path therebetween that is used to transfer electric power between the connector assembly 102 and the mating connector assembly 104. The interlock circuit contact 406 mates with corresponding mating interlock contacts 900 (shown in FIG. 8) in the mating connector assembly 104. The mating interlock contacts 900 may be electrically joined with an interlock circuit that controls transfer of electric power through the power supply contacts 300 and/or the mating power contacts 200. For example, the mating interlock contacts 900 may be coupled with an HVIL circuit 172 that includes computer-programmable or hard-wired logic that governs when electric current is transferred between the connector assembly 102 and the mating connector assembly 104 using the power supply contacts 300.

The header connector assembly 104 includes an outer housing 126 that longitudinally extends between a mating face 128 and a mounting face 130. The mating face 128 mates with the connector assembly 102 and the mounting face 130 may be mounted or otherwise coupled with a module 132 (shown in FIG. 1), such as a power distribution module. The housing 126 also extends between opposite top and bottom sides 134, 136, and between opposite sides 138, 140. Several cables 142, 144 (shown in FIG. 1) extend from an opposite side of the module 132 to which the mating connector assembly 104 is mounted into the housing 126. The cables 142, 144 are electrically coupled with contacts disposed within the housing 126. For example, the cables 142, 144 may include conductors similar to the conductors 116 described above that are electrically joined with the mating power contacts 200 (shown in FIG. 2) and mating interlock contacts 900 (shown in FIG. 8). The mating power contacts 200 mate with the power supply contacts 300 (shown in FIG. 2) of the connector assembly 102 to provide one or more electrically communicative paths therebetween that is used to transfer electric power between the connector assembly 102 and the mating connector assembly 104. The mating interlock contacts 900 mate with the interlock circuit contact 406 (shown in FIG. 4) of the connector assembly 102. The cable 144 may be coupled with the mating interlock contacts 900 to couple the mating interlock contacts 900 with the interlock circuit 172 that controls transfer of electric power through the power supply contacts 300 and/or the mating power contacts 200.

In the illustrated embodiment, the connector assembly 102 includes a lever subassembly 146 coupled to the housing 106. The lever subassembly 146 is manually actuated to move the connector assembly 102 toward and/or away from the mating connector assembly 104. For example, the lever subassembly 146 includes a handle 148 that is pivotally coupled to the housing 106 such that the handle 148 rotates relative to the housing 106 about a pivot axis 150. The handle 148 may rotate in opposite directions along a mating arc 160 from a rearward position (as shown in FIGS. 1 and 3), where the handle 148 is located closer to the rear side 110 of the housing 106 than the mating face 108, to a forward position (as shown in FIGS. 12 through 15), where the handle 148 is located closer to the mating face 108 than the rear side 110, in order to mate the connector assembly 102 with the mating connector assembly 104. The handle 148 may be rotated in an opposite direction toward the rear side 110 to unmate the connector assembly 102 from the mating connector assembly 104.

The handle 148 is joined with gripping ends 152 at or near the positions where the handle 148 is pivotally connected with the housing 106. In the illustrated embodiment, the gripping ends 152 include pivot pins 1102 (shown in FIG. 10) that pivotally couple the lever subassembly 146 and the handle 148 to the housing 106. The gripping ends 152 may have teeth 302 (shown in FIG. 3) that radially project from the pivot pins 1102 along an outer perimeter or periphery of the pivot pins 1102. The teeth 302 rotate when the handle 148 rotates and may mesh with teeth 158 on the sides 138, 140 of the housing 126 of the mating connector assembly 104. The engagement between the teeth 302, 158 as the gripping ends 152 and the handle 148 rotate relative to the housing 126 of the mating connector assembly 104 may cause the connector assembly 102 to linearly move relative to the mating connector assembly 104. For example, the teeth 302 of the connector assembly 102 may mesh with the linearly aligned teeth 158 of the mating connector assembly 104 to translate rotation of the handle 148 into linear movement of the connector assembly 102 relative to the mating connector assembly 104.

In the illustrated embodiment, rotation of the handle 148 along the mating arc 160 toward the mating face 108 causes the gripping ends 152 of the lever subassembly 146 to engage the housing 126 of the mating connector assembly 104 and cause the housing 106 of the connector assembly 102 to be linearly translated along a mating direction 162 (shown in FIG. 1). For example, the engagement of the teeth 158, 302 with one another may translate the housing 106 of the connector assembly 102 along the mating direction 162 and provide a mating force to mate the connector assembly 102 with the mating connector assembly 104. Conversely, rotation of the handle 148 along the mating arc 160 toward the rear side 110 may cause the housing 106 of the connector assembly 102 to be linearly translated along an unmating direction 164 (shown in FIG. 1). For example, the engagement of the teeth 158, 302 with one another may translate the housing 106 of the connector assembly 102 along the unmating direction 164 and provide an unmating force to separate the connector assembly 102 from the mating connector assembly 104.

A lever latch 154 engages the lever subassembly 146 when the handle 148 is rotated during mating and/or unmating of the connector assembly 102 and mating connector assembly 104. The lever latch 154 may be a cantilevered beam disposed along the top side 118 of the housing 106. The lever latch 154 may be biased downward into the housing 106. In the illustrated embodiment, the lever subassembly 146 includes a slide bar 156 that engages the lever latch 154 during mating and unmating of the connector assembly 102 and the mating connector assembly 104. As shown in FIG. 3, the slide bar 156 extends between opposite front and rear ends 304, 306, between opposite sides 308, 310, and between opposite top and bottom sides 312, 314. The slide bar 156 may include a latch opening 316 (shown in FIG. 3) that extends through the slide bar 156 from the bottom side 314 to the top side 312.

The slide bar 156 may slide along the top side 118 of the housing 106 of the connector assembly 102 along the mating direction 162 and the unmating direction 164. For example, the slide bar 156 may be pivotally coupled to the handle 148 such that rotation of the handle 148 in opposite directions along the arc 160 causes the slide bar 156 to move in corresponding directions along the mating and unmating directions 162, 164. The slide bar 156 engages slots 170 of the housing 106 that extend along the top side 118. The slide bar 156 slides along the slots 170 over the housing 106. In the illustrated embodiment, the slide bar 156 includes pins 166 that protrude from the slide bar 156 in opposite directions. The pins 166 are received in arcuate slots 168 of the lever subassembly 146. For example, the lever subassembly 146 may include the arcuate slots 168 disposed near gripping ends 152 of the handle 148. The pins 166 may slide within the slots 168 as the handle 148 is rotated along the mating arc 160 such that rotation of the handle 148 is translated into linear motion of the slide bar 156.

Figure 4:
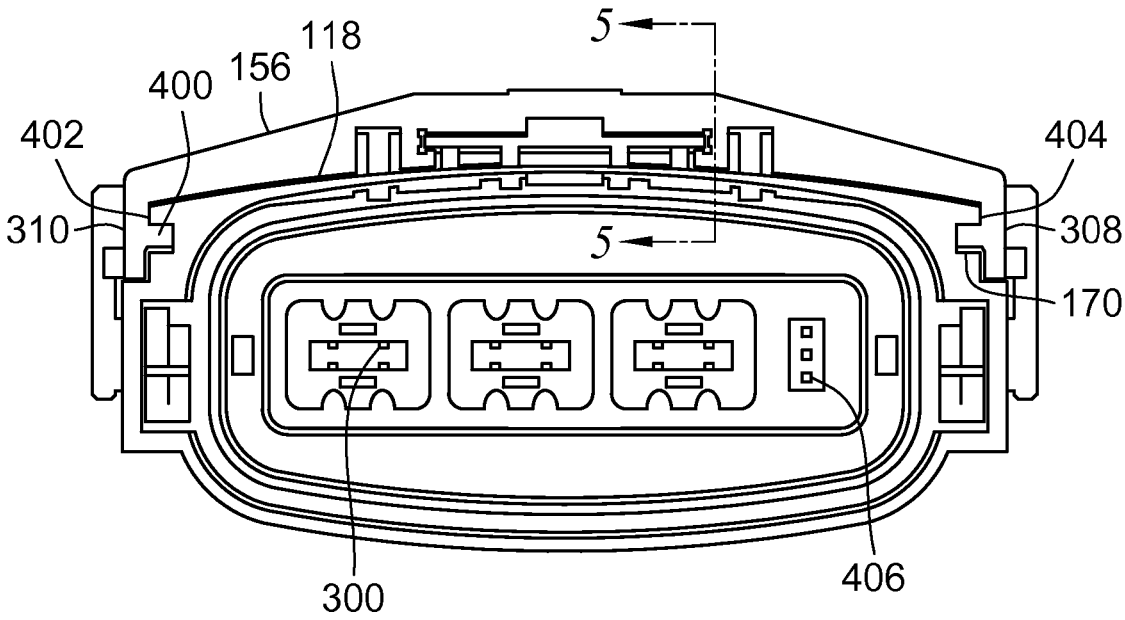
FIG. 4 is a front elevational view of the connector assembly shown in FIG. 1 in accordance with one embodiment of the present disclosure.

FIG. 4 is a front elevational view of the mating connector assembly 102 in accordance with one embodiment of the present disclosure. The slide bar 156 includes inwardly protruding rails 400 that protrude from inner surfaces 402, 404 of the opposite sides 308, 310. The rails 400 are received in the slots 170 of the housing 106 to guide the slide bar 156 along the top side 118 of the housing 106. As shown in FIG. 4, the connector assembly 102 includes three of the power supply contacts 300 and a single interlock circuit contact 406. Alternatively, a different number and/or arrangement of the power supply contacts 300 and/or interlock circuit contact 406 may be provided.

Figure 5:
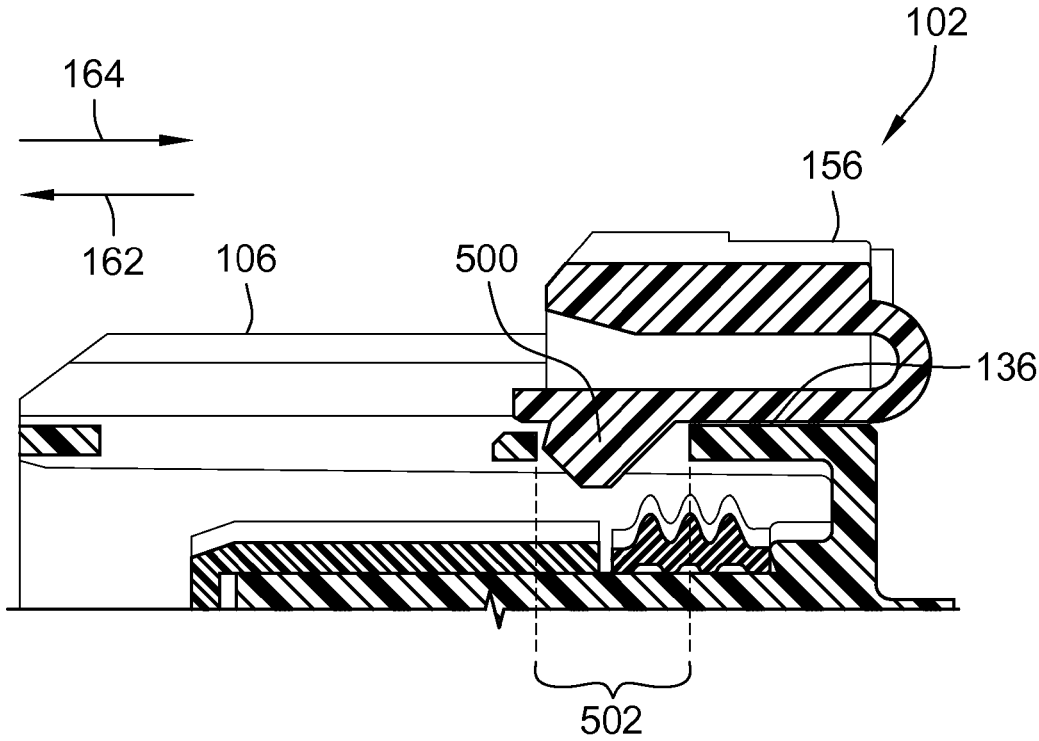
FIG. 5 is a partial cross-sectional view of the connector assembly shown in FIG. 1 taken along line 5-5 shown in FIG. 4 in accordance with one embodiment of the present disclosure.

FIG. 5 is a partial cross-sectional view of the connector assembly 102 taken along line 5-5 shown in FIG. 4 in accordance with one embodiment of the present disclosure. The slide bar 156 may include a locking latch 500 coupled to the bottom side 314 of the slide bar 156. The locking latch 500 may be a cantilevered beam that is flexible or capable of being biased without plastically deforming the latch 500. For example, the locking latch 500 may be capable of being biased upward toward the slide bar 156. In the illustrated embodiment, the top side 118 of the housing 106 of the connector assembly 102 includes a latch opening 502. The locking latch 500 is received into the latch opening 502 and engages the housing 106 when the slide bar 156 is moved away from the mating face 108 (shown in FIG. 1) of the housing 106. For example, the handle 148 (shown in FIG. 1) may be rotated backward toward the rear side 110 (shown in FIG. 1) of the housing 106 to slide the slide bar 156 along the unmating direction 164. The slide bar 156 may move in the unmating direction 164 until the locking latch 500 snaps into the latch opening 502.

The locking latch 500 engages the housing 106 within the latch opening 502 to prevent the slide bar 156 from moving relative to the housing 106. For example, the locking latch 500 may engage the housing 106 to prevent the slide bar 156 from moving in the mating direction 162. In one embodiment, the locking latch 500 engages the housing 106 to prevent the slide bar 156 from moving in the mating direction 162, which in turn prevents the handle 148 (shown in FIG. 1) from rotating toward the mating face 108 of the housing 106. The locking latch 500 may therefore prevent the connector assembly 102 from mating with the mating connector assembly 104 (shown in FIG. 1). For example, if the locking latch 500 prevents the slide bar 156 from moving in the mating direction 162, the slide bar 156 may be unable to move and prevent the handle 148 from forwardly rotating.

The connector assembly 102 mates with the mating connector assembly 104 (shown in FIG. 1) in a multi-stage mating sequence. The mating sequence sequentially mates the power supply contacts 300 (shown in FIG. 3) with the mating power contacts 200 (shown in FIG. 2) and the interlock circuit contact 406 (shown in FIG. 4) with the mating interlock contacts 900 (shown in FIG. 8). For example, the mating sequence mates the power supply contacts 300 with the mating power contacts 200 prior to mating the interlock circuit contact 406 with the mating interlock contacts 900. The mating sequence mates the contacts in this order to ensure that the power contacts 300, 200 are coupled prior to the interlock contacts 406, 900 being coupled. Likewise, the connector assembly 102 unmates from the mating connector assembly 104 in a multi-stage unmating sequence. The unmating sequence sequentially unmates the interlock circuit contact 406 from the mating interlock contacts 900 and the power supply contacts 300 from the mating power contacts 200. For example, the unmating sequence causes the interlock contacts 406, 900 to unmate with one another prior to the unmating of the power contacts 200, 300. The unmating sequence also introduces a time delay between the unmating of the interlock contacts 406, 900 and the unmating of the power contacts 200, 300 in order to cut off the supply of electric power through the power contacts 200, 300 while keeping the power contacts 200, 300 mated for a sufficient time for electronic components, such as capacitors, to discharge built-up electric charge.

Figure 6:
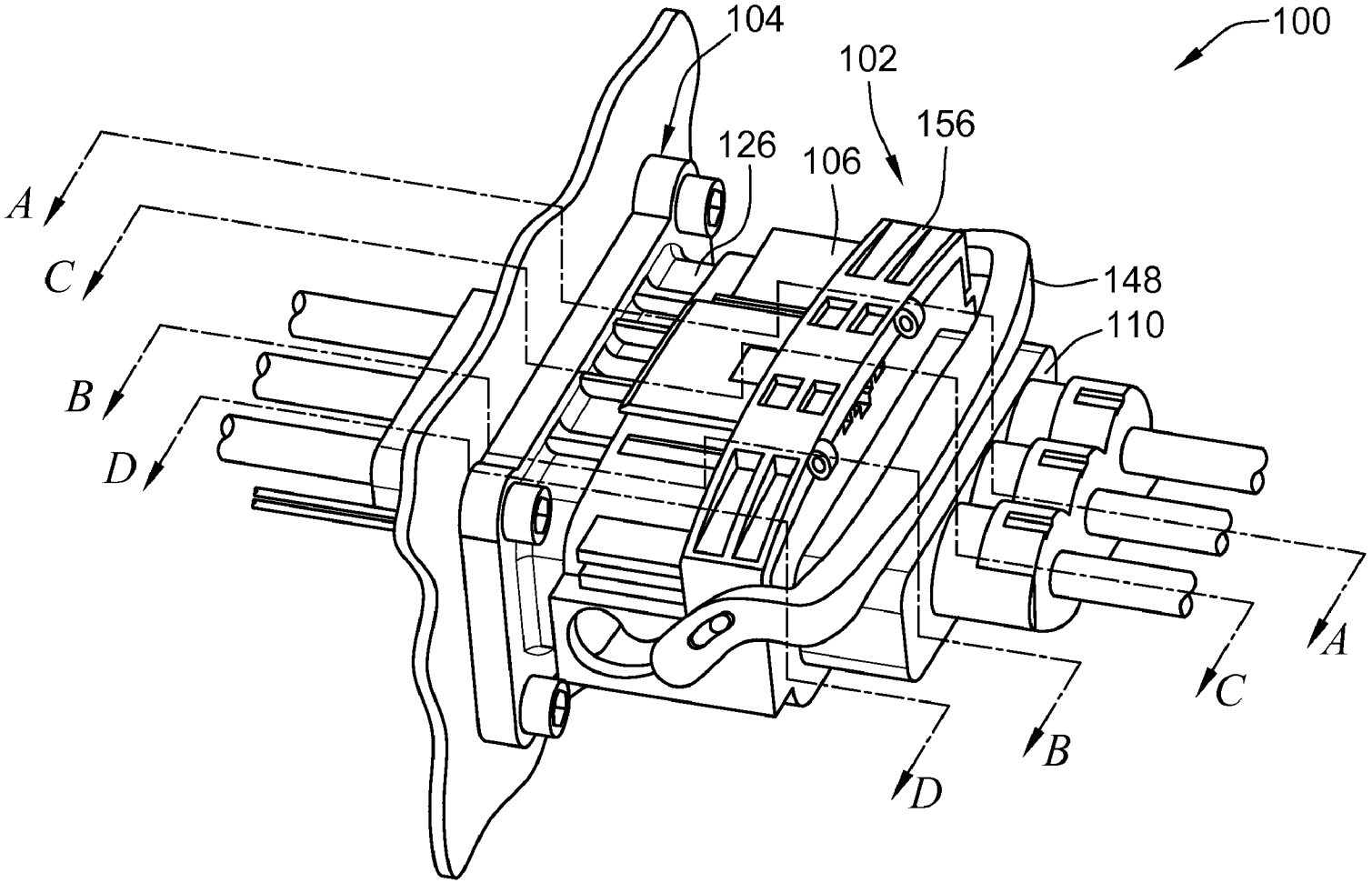
FIG. 6 is an elevational view of the connector assembly shown in FIG. 1 in accordance with one embodiment of the present disclosure.
Figure 7:
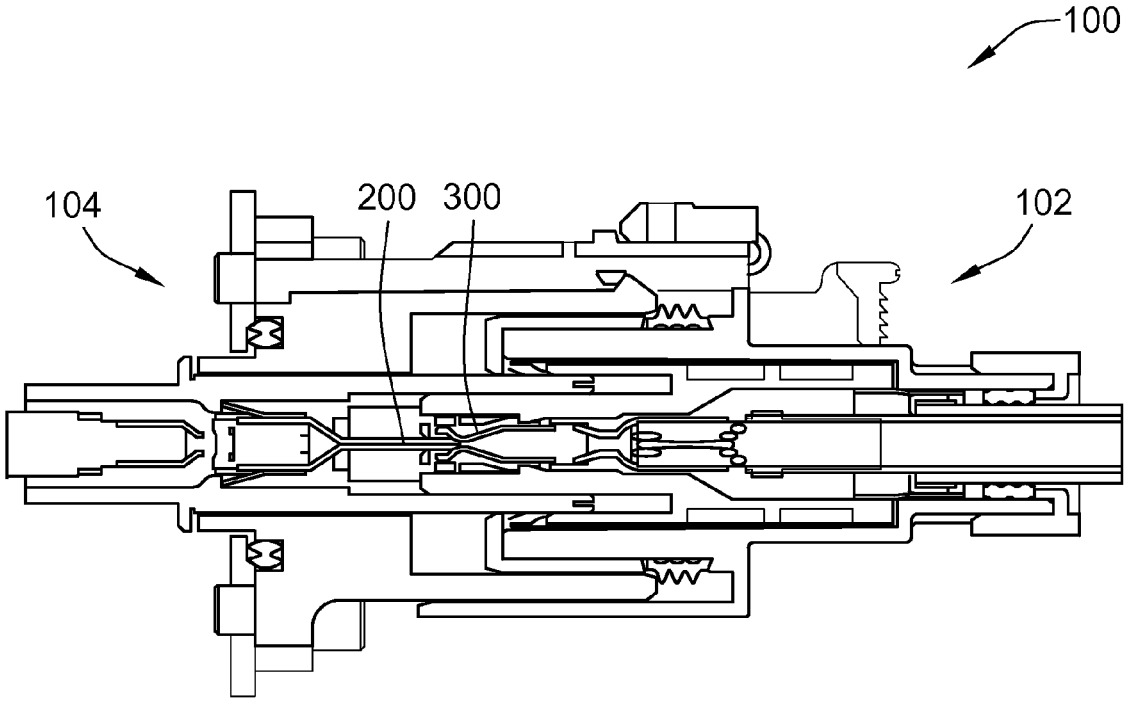
FIG. 7 is a cross-sectional view of the connector assembly shown in FIG. 1 taken along line A-A in the first stage of the mating sequence as shown in FIG. 6.

FIG. 6 is a perspective view of the connector assembly 100 in a first stage of the multi-stage mating sequence in accordance with one embodiment of the present disclosure. As shown in FIG. 7, the housing 126 of the mating connector assembly 104 is received in the housing 106 of the connector assembly 102. The handle 148 and slide bar 156 may be located toward the rear side 110 FIG. 6 of the connector assembly 102 in the first stage of the mating sequence. The connector assembly 102 is loaded into the housing 126 of the mating connector assembly 104 until the power supply contacts 300 (shown in FIG. 3) of the connector assembly 102 mate with the mating power contacts 200 (shown in FIG. 2) of the mating connector assembly 104.

FIG. 6 may be used to illustrate the relationship of the various components of the connector assembly 100 (shown in FIG. 1) during the various stages of the mating/unmating sequences described below. For example, cross-sectional views taken generally along line A-A (see FIG. 7) may be used to illustrate the relationship of the power contacts 200 (shown in FIG. 2), 300 relative to one another during the various stages of the mating and unmating sequences. Cross-sectional views generally taken along line B-B (see FIG. 8) may be used to demonstrate the relationship of the interlock circuit contacts 406, 900 (shown in FIG. 8) relative to one another. Cross-sectional views taken along line C-C (see FIG. 9) may illustrate the relationship of the locking latch 500 (shown in FIG. 5) of the connector assembly 102 relative to the housing 106 of the connector assembly 102 and/or to the mating connector assembly 104 (shown in FIG. 1). Cross-sectional views taken along line D-D (see FIG. 10) show the relationship of the gripping ends 152 of the lever subassembly 146.

FIG. 7 is a cross-sectional view of the connector assembly 100 taken along line A-A in the first stage of the mating sequence as shown in FIG. 6. FIG. 7 shows the power supply contacts 300 of the connector assembly 102 in contact or engaged with the mating power contacts 200 of the mating connector assembly 104. For example, the mating power contacts 200 are shown received within and engaged to the power supply contacts 300.

Figure 8:
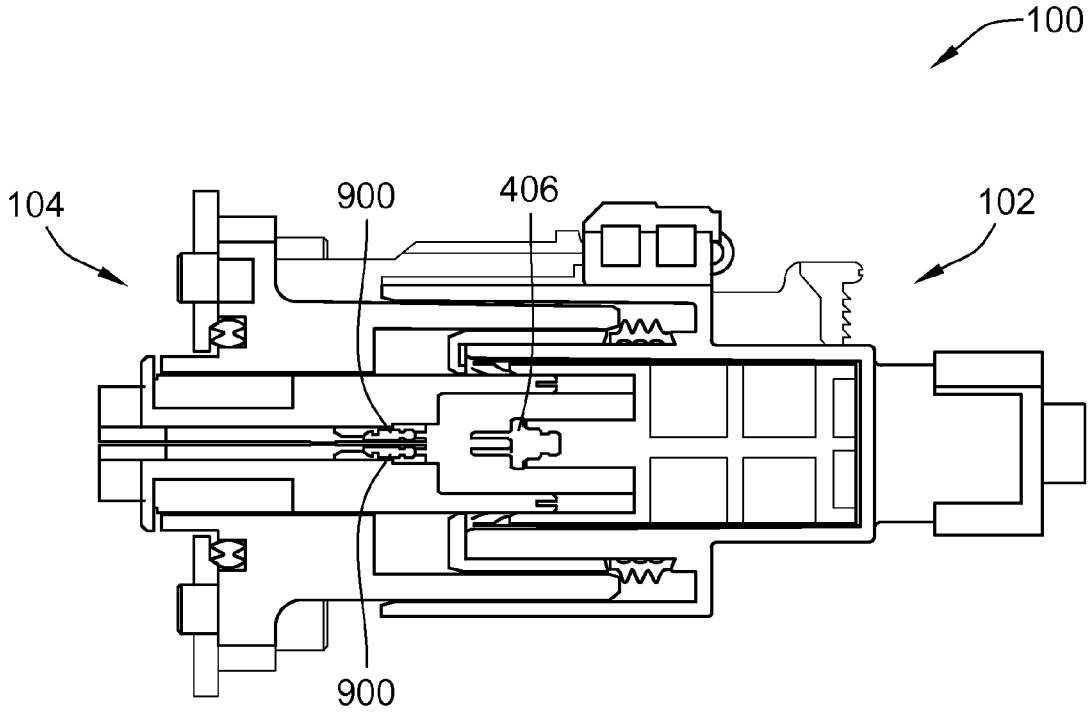
FIG. 8 is a cross-sectional view of the connector assembly shown in FIG. 1 taken along line B-B in the first stage of the mating sequence as shown in FIG. 6.
Figure 9:
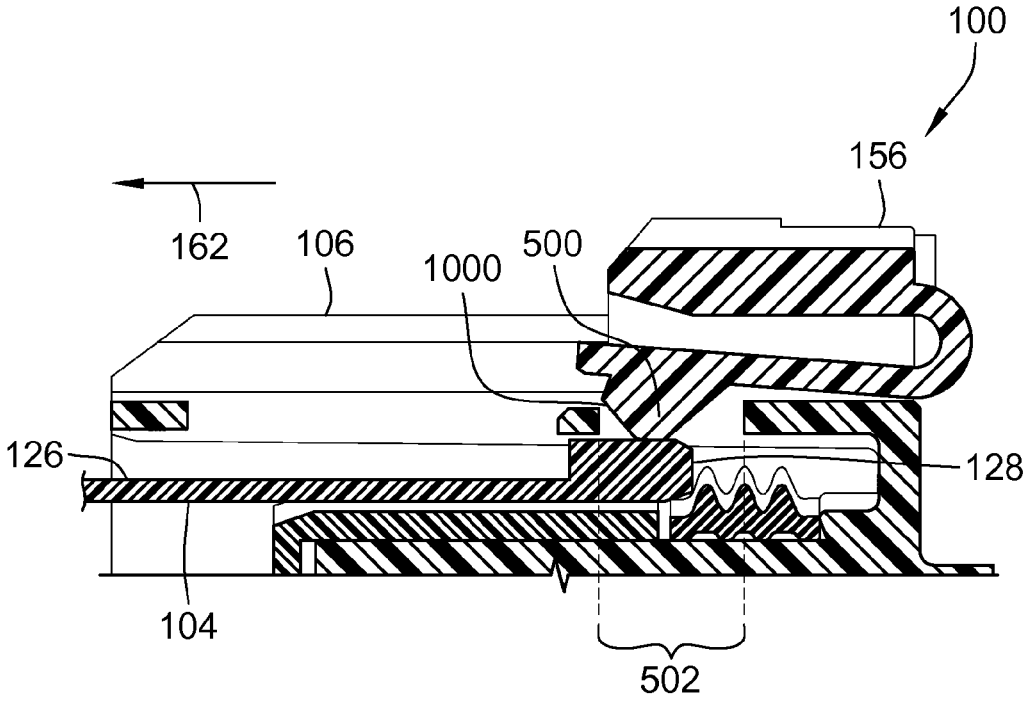
FIG. 9 is a cross-sectional view of the connector assembly shown in FIG. 1 taken along line C-C in the first stage of the mating sequence as shown in FIG. 6.

FIG. 8 is a cross-sectional view of the connector assembly 100 taken along line B-B in the first stage of the mating sequence as shown in FIG. 6. FIG. 8 shows the interlock circuit contact 406 of the connector assembly 102 unmated from the mating interlock contact 900 of the mating connector assembly 104. For example, the interlock circuit contact 406 is separated from the mating interlock contact 900. As shown in FIGS. 7 through 9, the power contacts 200 (shown in FIG. 2), 300 (shown in FIG. 3) are mated with one another while the interlock contacts 406, 900 are unmated and separated from one another. Therefore, in the first stage of the mating sequence, the power contacts 200, 300 are coupled to transfer electric power therebetween, but the interlock contacts 406, 900 are separated from one another. As a result, the connector assembly 100 does not transfer electric power between the power contacts 200, 300. The connector assembly 100 may only transfer electric power between the power contacts 200, 300 when the interlock contacts 406, 900 are coupled with one another.

Figure 23:
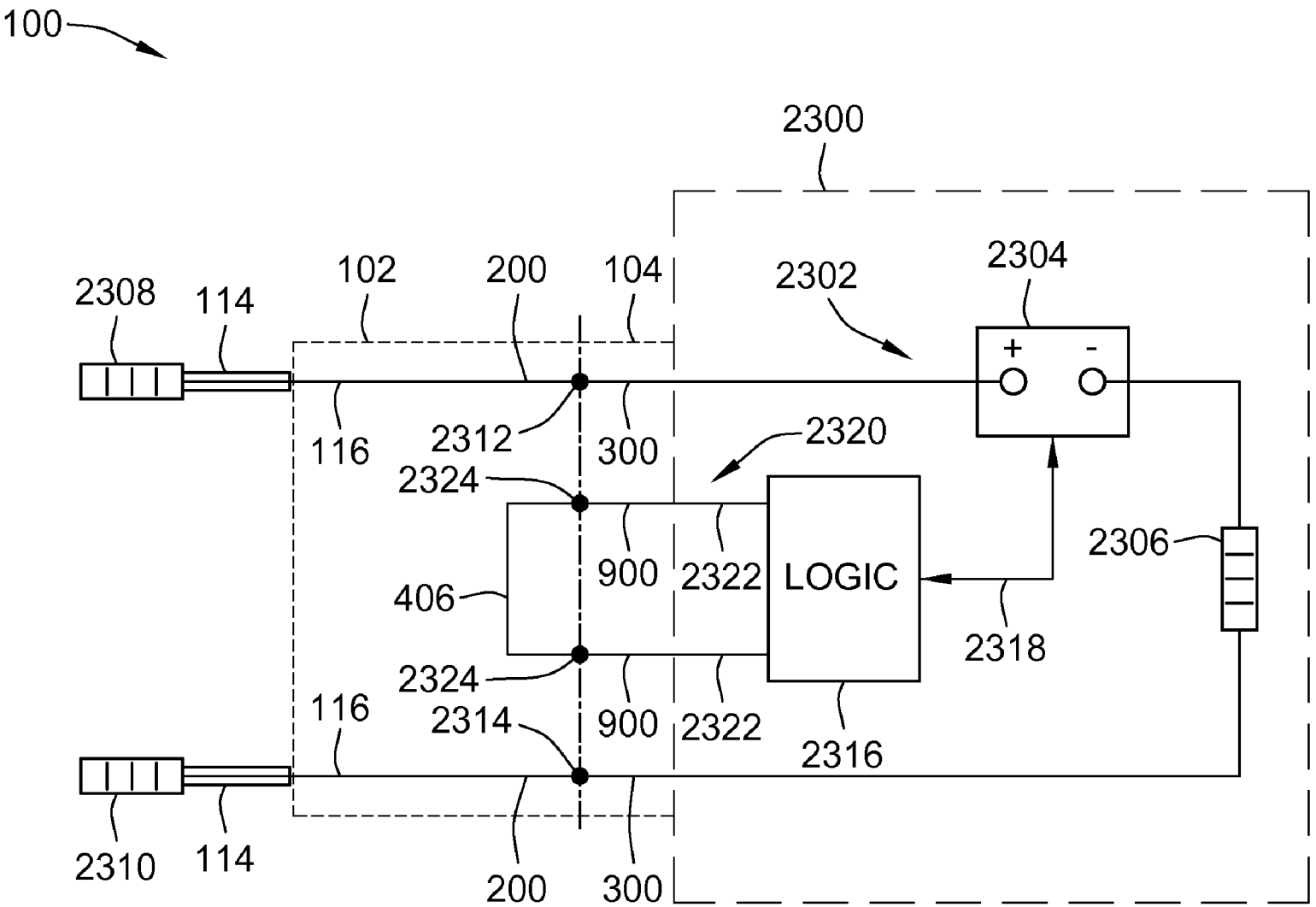
FIG. 23 is a schematic circuit diagram of a connector assembly in accordance with one embodiment.

FIG. 23 is a schematic circuit diagram of the connector assembly 100 in accordance with one embodiment. The diagram of FIG. 23 illustrates how the connector assembly 100 controls the transfer of power via the power contacts 200, 300 based on the mating and unmating of the interlock contacts 406, 900. The assembly 100 is shown in a mated relationship with the assemblies 102, 104 shown in dashed lines and the assembly 104 shown mounted to the power distribution module 2300. The power distribution module 2300 includes a power supply circuit 2302. The power supply circuit 2302 electrically interconnects a power source 2304 with an electrical load 2306. While the electrical load 2306 is shown as being internal to the module 2300, alternatively the load 2306 may be outside of the module 2300.

The power source 2304 may be a high voltage power source. For example, the power source 2304 may be a battery that supplies at least approximately 15 volts of alternating current or a source of at least approximately 30 volts of direct current. In the illustrated embodiment, the power source 2304 is shown as a direct current power source, but alternatively may be an alternating current power source. The electrical load 2306 includes a device, system, apparatus, or other component that receives and uses the current supplied by the power source 2304. For example, in the illustrated embodiment, the electrical load 2306 is shown as a heater. Alternatively, the electrical load 2306 may be another device such as an air conditioning unit. While only a single power source 2304 and a single electrical load 2306 are shown as part of the power supply circuit 2302, alternatively the power supply circuit 2302 may include multiple power sources 2304 and/or electrical loads 2306.

The fused conductive pathway 720 is internal to the IFC assembly 102 in one embodiment. For example, the fuse 250 and the conductive terminals 240, 242 (schematically represented in FIG. 7) may be internal to the IFC assembly 102. The fused conductive pathway 720 may be entirely enclosed within the IFC assembly 102, with no part or component of the fused conductive pathway 720 being separate from, or external to, the IFC assembly 102.

The power supply circuit 700 is internal to the power distribution module 106 in one embodiment. For example, the power supply circuit 700 may include the power source 702, the electrical load 704 and several conductive pathways 706 that internally interconnect the power source 702 and electrical load 704. The power supply circuit 700 may be entirely enclosed within the power distribution module 106. For example, the power source 702, electrical load 704 and conductive pathways 706 may not extend beyond the outer or exterior surfaces of the power distribution module 106. The conductive pathways 706 may extend to nodes 708 that are disposed at or near the exterior surface 108 of the power distribution module 106. For example, the conductive pathways 706 may be joined with the contacts 126 (shown in FIG. 1) of the header assembly 104 (shown in FIG. 1). The contacts 126 may be represented as the nodes 708 in FIG. 7.

The conductors 116 of the assembly 102 may be electrically joined with one or more electrical loads 2308, 2310. For example, the cables 114 may extend to and be coupled with one or more external loads 2308, 2310 to transfer power to the loads 2308, 2310 via the assembly 102. The power may be supplied from the power distribution module 2300 and transferred to the loads 2308, 2310 via the mated assemblies 102, 104. The assemblies 102, 104 mate to close the power supply circuit 2302. Prior to mating the assembly 102 with the assembly 104, the power supply circuit 2302 may be an open circuit. For example, the power supply circuit 2302 may be open between nodes 2312, 2314 and electric current may not be passed along the power supply circuit 2302 prior to mating the assemblies 102, 104. Mating the assemblies 102, 104 closes the power supply circuit 2302. For example, the mating of the assembly 102 with the assembly 104 electrically couples the power contacts 200, 300 with one another at the nodes 2312, 2314. The assembly 102 couples with the assembly 104 at the nodes 2312, 2314. Electric current may pass along the power supply circuit 2302 from the power source 2304 to the electrical loads 2308, 2310 once the assemblies 102, 104 mate.

The power distribution module 2300 may include a logic device 2316 that communicates with the power source 2304. The logic device 2316 may be embodied in one or more computer logic components, such as a microcontroller, processor, microprocessor, computer, and/or software operating on a processor, microprocessor, or computer. The logic device 2316 directs the power source 2304 to supply and to cut off supply of current to the electrical loads 2308, 2310. For example, the logic device 2316 may direct the power source 2304 to begin supplying high voltage current to the electrical loads 2308, 2310 via the assembly 102 once the assemblies 102, 104 are mated and the circuit 2302 is closed. Conversely, the logic device 2316 may direct the power source 2304 to stop supplying high voltage current to the electrical loads 2308, 2310 via the assembly 102 when the assemblies 102, 104 are partially or no longer mated. The logic device 2316 may communicate with the power source 2304 via control signals communicated via one or more conductive pathways 2318, such as wires or buss bars, for example.

An interlock circuit 2320 in the power distribution module 2300 electrically interconnects the logic device 2316 with conductive pathways 2322 in the illustrated embodiment. The conductive pathways 2322 electronically couple the logic device 2316 with the interlock contacts 900 in the assembly 104.

The interlock contacts 900 mate with the interlock contact 406 of the assembly 102 at nodes 2324. In one embodiment, the mating of the assemblies 102, 104 closes the interlock circuit 2320. For example, the mating of the assemblies 102, 104 couple the interlock contacts 406, 900 at the nodes 2324. Prior to mating the assemblies 102, 104, the interlock circuit 2320 is open between the nodes 2324. The interlock contact 406 closes the interlock circuit 2320 between the nodes 2324. The logic device 2316 detects when the interlock circuit 2320 is closed and directs the power source 2304 to begin supplying current to the electrical loads 2308, 2310 via the assembly 102.

As described herein, the assemblies 102, 104 mate with one another in a mating sequence that causes the power contacts 200, 300 to close the power supply circuit 2302 prior to the interlock contacts 406, 900 closing the interlock circuit 2320. The closing of the power supply circuit 2302 prior to the closing of the interlock circuit 2320 may ensure that power is not supplied across the power supply circuit 2302 until the power supply circuit 2302 is closed by the assembly 102. The assemblies 102, 104 may unmate from one another in an unmating sequence that causes the interlock circuit 2320 to be opened prior to opening the power supply circuit 2302. For example, the interlock contacts 406, 900 may disengage one another prior to the power contacts 200, 300 decoupling from one another. The delayed opening of the power supply circuit 2302 relative to the interlock circuit 2320 provides additional time for additional electronic components, such as capacitive elements along the power supply circuit 2302, to discharge built up electrical energy before opening the power supply circuit 2302. Otherwise, the built-up charge may damage the elements along the power supply circuit 2302.

FIG. 9 is a partial cross-sectional view of the connector assembly 100 taken along line C-C in the first stage of the mating sequence as shown in FIG. 6. In the illustrated embodiment, the housing 106 of the connector assembly 102 is loaded into the housing 126 of the mating connector assembly 104. The mating face 128 of the housing 126 is loaded into the connector assembly 102 until the housing 126 engages the locking latch 500 of the slide bar 156. For example, the housing 126 may be advanced within the connector assembly 102 until the housing 126 upwardly biases the locking latch 500. The housing 126 may bias the locking latch 500 upward to lift the locking latch 500 sufficiently far that the locking latch 500 no longer engages the housing 106 of the connector assembly 102 For example, the locking latch 500 may include an angled surface 1000 that permits the locking latch 500 to slide out of the latch opening 502 when the slide bar 156 is moved along the mating direction 162 relative to the housing 106. Alternatively, the housing 126 of the mating connector assembly 104 may upwardly bias the locking latch 500 completely out of the latch opening 502.

Figure 10:
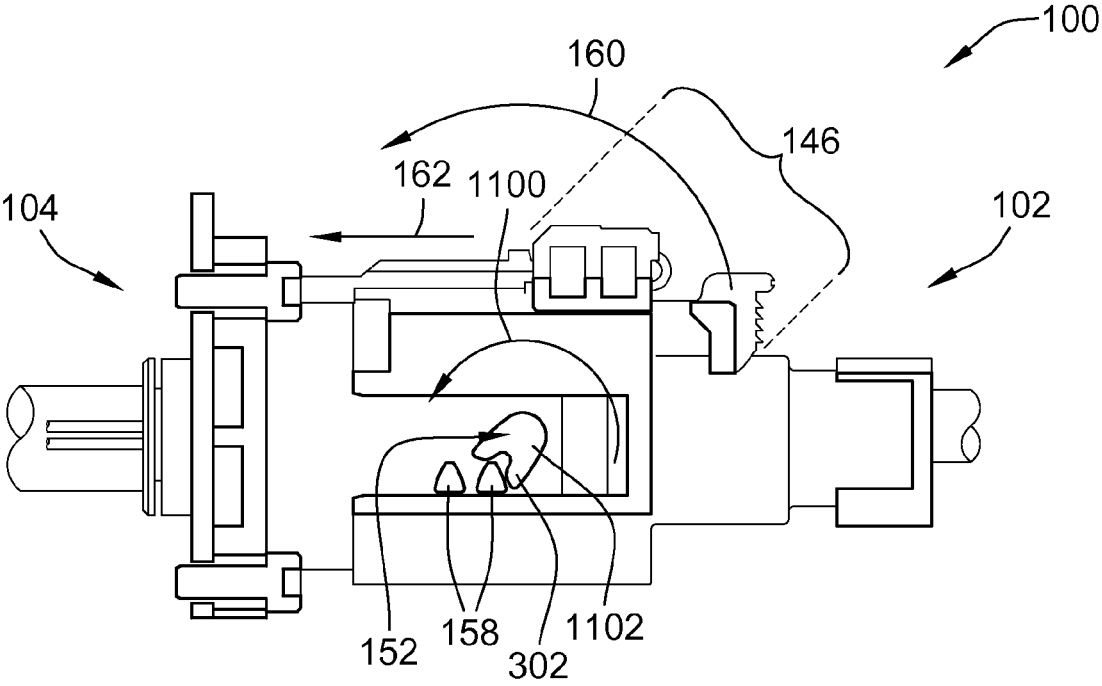
FIG. 10 is a cross-sectional view of the connector assembly shown in FIG. 1 taken along line D-D in the first stage of the mating sequence as shown in FIG. 6.

FIG. 10 is a cross-sectional view of the connector assembly 100 taken along line D-D in the first stage of the mating sequence as shown in FIG. 6. As shown in FIG. 10, the teeth 302 of the gripping ends 152 of the lever subassembly 146 engage the teeth 158 of the mating connector assembly 104. In the first stage of the mating sequence, the teeth 158, 302 have not yet meshed with one another, although the teeth 302 are in a position to engage the teeth 158 and linearly displace the connector assembly 102 toward the mating connector assembly 104 with rotation of the handle 148 along the mating arc 160 toward the mating connector assembly 104. For example, rotation of the teeth 302 along an advancement arc 1100 may cause the teeth 302 to mesh with teeth 158 and linearly advance the connector assembly 102 in the mating direction 162.

Figure 11:
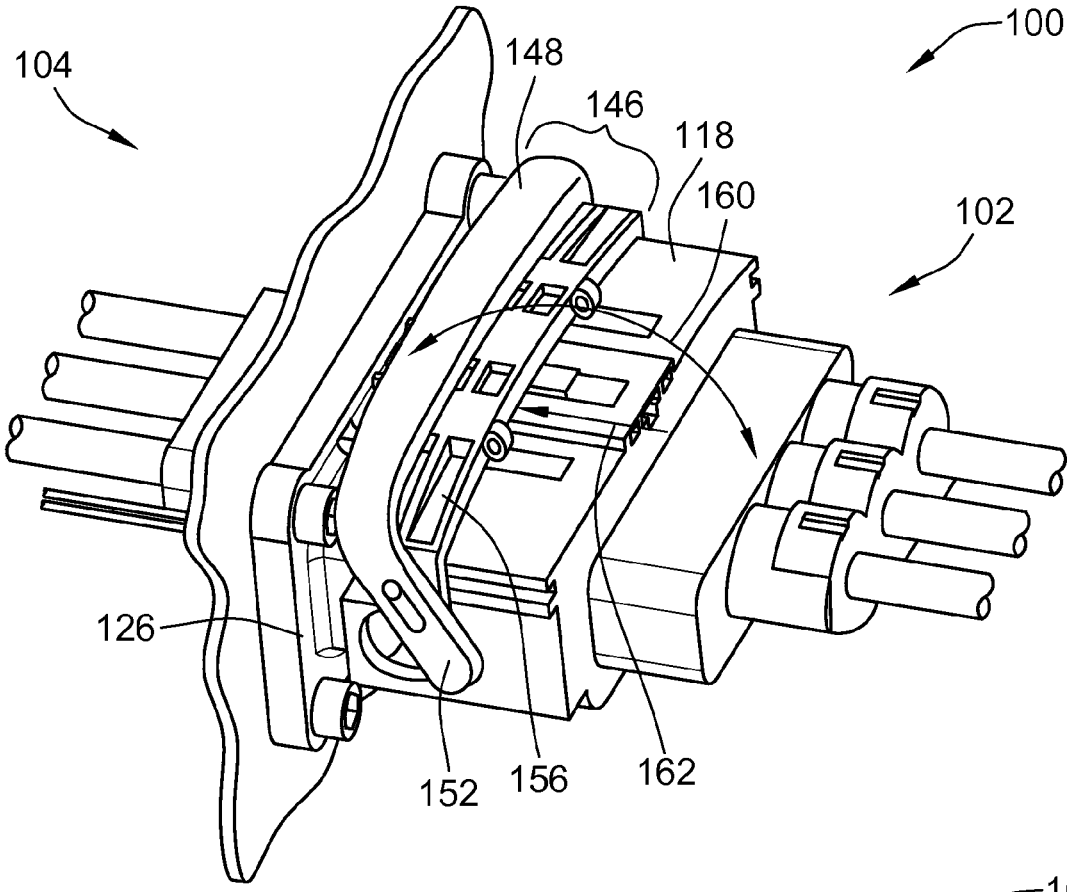
FIG. 11 is a perspective view of the connector assembly shown in FIG. 1 in a second stage of the mating sequence in accordance with one embodiment of the present disclosure.

FIG. 11 is a perspective view of the connector assembly 100 in a second stage of the mating sequence in accordance with one embodiment of the present disclosure. The second stage is also the mated position. Alternatively, the mated position shown in FIG. 11 may be referred to as a first stage of an unmating sequence of the connector assembly 100. For example, if the connector assembly 102 is being unmated from the mating connector assembly 104, then the stage shown in FIG. 11 may be the first stage or step in unmating the connector assembly 102 from the mating connector assembly 104.

The connector assembly 100 is shown in a mated position or relationship in FIG. 11. For example, the connector assembly 102 and the mating connector assembly 104 are mated with one another in the second stage of the mating sequence. As shown in FIG. 11, the handle 148 of the lever subassembly 146 has been rotated along the mating arc 160 toward the mating face 108 (shown in FIG. 1) of the connector assembly 102. As a result, the slide bar 156 has been advanced along the top side 118 of the connector assembly 102 in the mating direction 162 toward the mating face 108. Additionally, the gripping ends 152 of the lever subassembly 146 have engaged the housing 126 of the mating connector assembly 104 to linearly advance the connector assembly 102 towards the mating connector assembly 104 to mate the two assemblies 102, 104 with one another.

Figure 12:
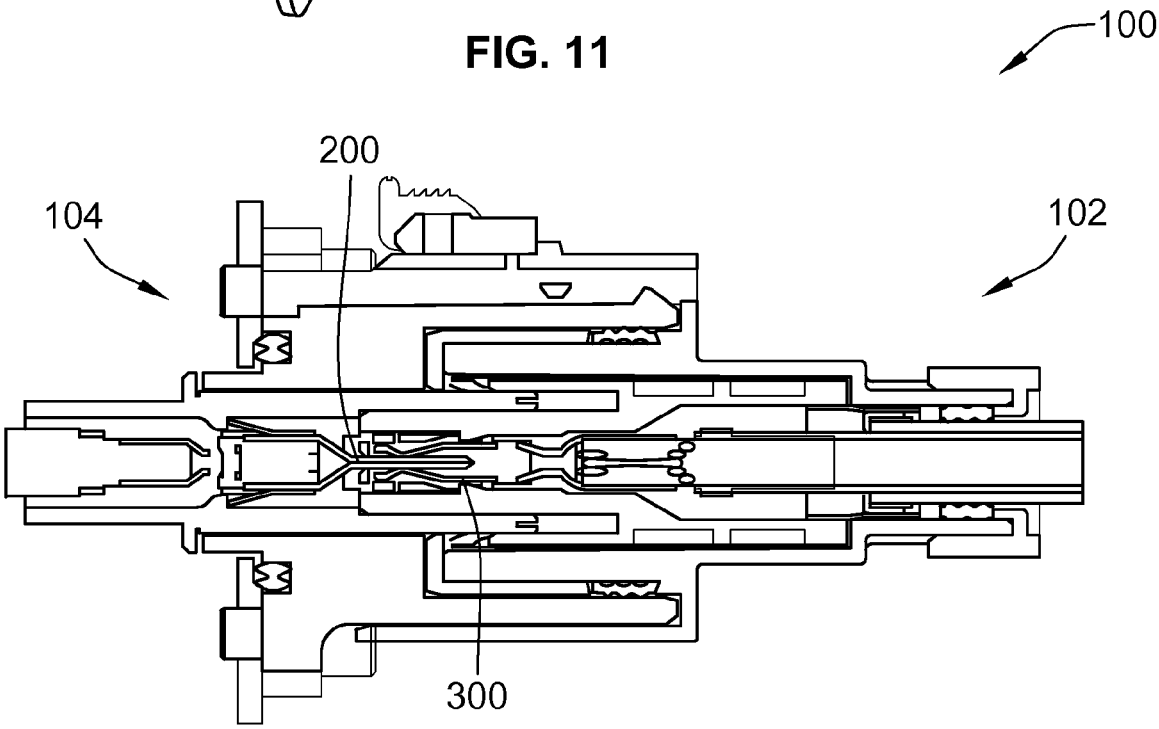
FIG. 12 is a cross-sectional view of the connector assembly shown in FIG. 1 taken along line A-A in the second stage of the mating sequence as shown in FIG. 11.

FIG. 12 is a cross-sectional view of the connector assembly 100 taken along line A-A in the second stage of the mating sequence as shown in FIG. 11. As described above, the power contacts 200, 300 mate with one another when the connector assembly 100 is in the first stage shown in FIG. 6. The advancement of the connector assembly 102 along the mating direction 162 toward the mating connector assembly 104 may move the power contacts 200, 300 from the engaged position shown in FIG. 7 to a mated, or fully coupled, position shown in FIG. 12. For example, the power contacts 200, 300 may continue to be moved toward one another as the connector assembly 102 moves along the mating direction 162 relative to the mating connector assembly 104. As shown in FIG. 12, the power supply contacts 300 and mating power contacts 200 are mated with one another with the mating power contacts 200 received farther into the power supply contacts 300 relative to the first stage of the mating sequence.

Figure 13:
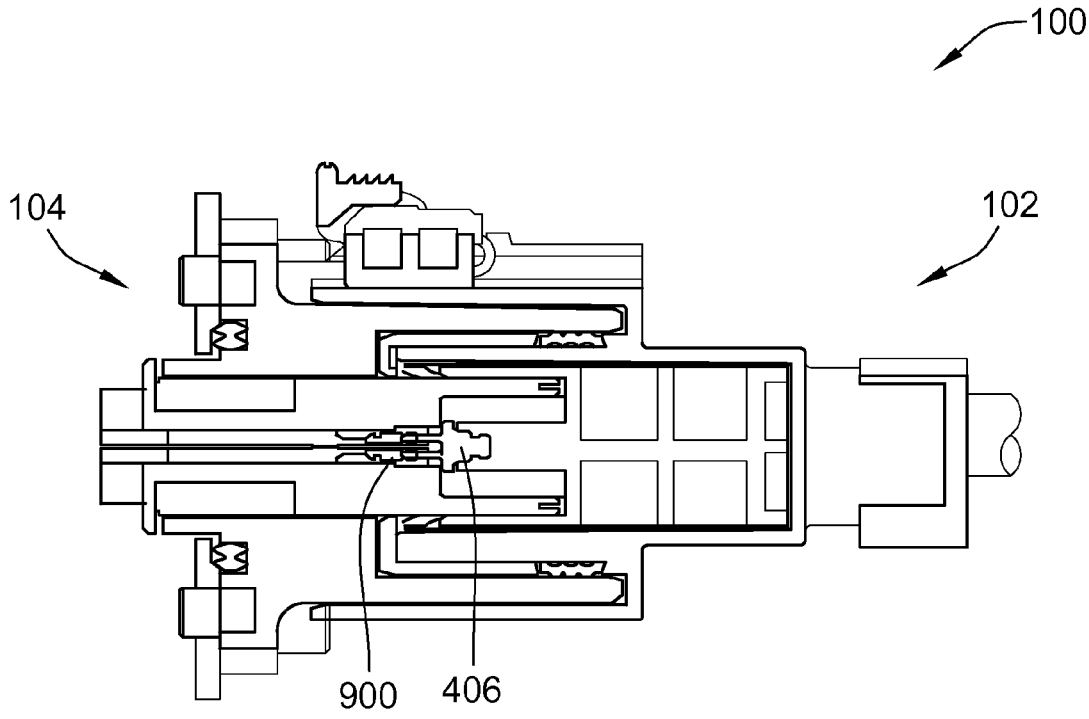
FIG. 13 is a cross-sectional view of the connector assembly shown in FIG. 1 taken along line B-B in the second stage of the mating sequence as shown in FIG. 11.
Figure 14:
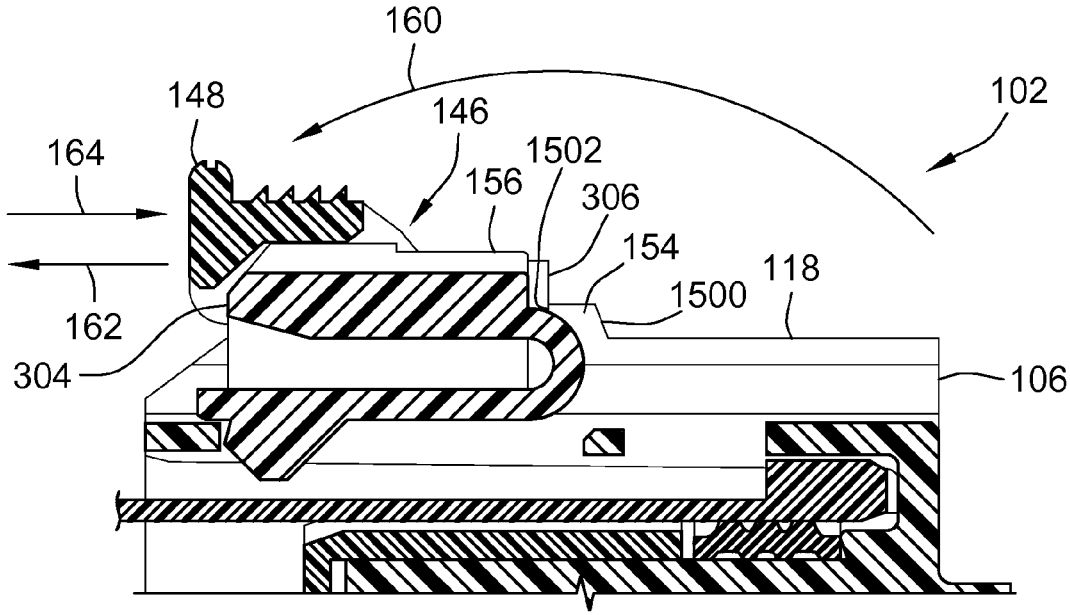
FIG. 14 is a cross-sectional view of the connector assembly shown in FIG. 1 taken along line C-C in the second stage of the mating sequence shown in FIG. 11.

FIG. 13 is a cross-sectional view of the connector assembly 100 taken along line B-B in the second stage of the mating sequence as shown in FIG. 11. The interlock circuit contact 406 of the connector assembly 102 is mated with the mating interlock contact 900 of the mating connector assembly 104 in the second stage. In the illustrated embodiment, the interlock circuit contact 406 is a body that includes or is formed from a conductive material, such as a metal or metal alloy. The interlock circuit contact 406 may engage the mating interlock contacts 900 to provide an electric shunt or short between the mating interlock contacts 900. The HVIL circuit 172 (shown in FIG. 1) may detect the mating of the interlock contacts 406, 900 as the closing of an interlock circuit that includes the interlock contacts 406, 900. As shown in FIGS. 13 and 14, the power contacts 200, 300 (shown in FIGS. 2 and 3) are mated with one another and the interlock contacts 406, 900 are mated with one another. Therefore, in the second stage of the mating sequence, the power contacts 200, 300 are coupled to transfer electric power therebetween and the interlock contacts 406, 900 are mated with one another. As a result, the HVIL circuit 172 causes electric power to be transferred between the power contacts 200, 300. For example, the connector assembly 100 may transfer electric power between the power contacts 200, 300 once an electrically conductive path is established between the interlock contacts 406, 900, as described above in connection with the example shown in FIG. 23.

FIG. 14 is a cross-sectional view of the connector assembly 100 taken along line C-C in the second stage of the mating sequence shown in FIG. 11. In the illustrated embodiment, the slide bar 156 slides along the top side 118 of the housing 106 of the connector assembly 102 in the mating direction 162 when the handle 148 is rotated along the mating arc 160 toward the mating face 108 (shown in FIG. 1) of the housing 106. The slide bar 156 is advanced in the mating direction 162 past the lever latch 154 of the housing 106. The slide bar 156 may move along the mating direction 162 until the front end 304 of the slide bar 156 engages the lever latch 154. The front end 304 biases the lever latch 154 downward into the housing 106 as the slide bar 156 continues to move in the mating direction 162. The lever latch 154 may move upward to an unbiased position after the slide bar 156 passes the lever latch 154. For example, the lever latch 154 may be downwardly biased until the rear end 306 passes the lever latch 154. At that point, the lever latch 154 may spring back up to the position shown in FIGS. 12 and 15.

In the illustrated embodiment, the lever latch 154 includes an angled rear surface 1500 and an opposite blocking surface 1502. The angled rear surface 1500 faces away from the mating face 108 (shown in FIG. 1) of the housing 106 and the blocking surface 1502 faces the mating face 108. As shown in FIG. 14, the angled rear surface 1500 is obliquely angled with respect to the front end 304 of the slide bar 156 while the blocking surface 1502 is approximately parallel to the rear end 306 of the slide bar 156. The rear surface 1500 is angled to permit the slide bar 156 to force the lever latch 154 downward when the slide bar 156 moves in the mating direction 162 and engages the rear surface 1500. The blocking surface 1502 is approximately parallel to the rear end 306 of the slide bar 156 to block rearward movement of the slide bar 156 after the slide bar 156 has moved along the mating direction 162 past the lever latch 154. For example, once the slide bar 156 is in the position shown in FIG. 14, rearward movement of the slide bar 156 along the unmating direction 164 is blocked by the blocking surface 1502 of the lever latch 154. In one embodiment, the lever latch 154 blocks movement of the slide bar 156 in the unmating direction 164 until the lever latch 154 is depressed or downwardly biased and moved out of the path of the slide bar 156. For example, a screwdriver or other tool may be used to depress the lever latch 154 to permit the handle 148 to be rearwardly rotated and the slide bar 156 to move in the unmating direction 164.

As described above, the connector assembly 102 unmates or is decoupled from the mating connector assembly 104 (shown in FIG. 1) in a multi-stage unmating or decoupling sequence. The sequence sequentially decouples the power contacts 300 (shown in FIG. 3) from the mating power contacts 200 (shown in FIG. 2) and the interlock circuit contacts 406 (shown in FIG. 4) from the mating interlock contacts 900 (shown in FIG. 8). The unmating sequence introduces a time delay between the decoupling of the interlock contacts 406, 900 and the decoupling of the power contacts 200, 300 in order to cut off the supply of electric power through the power contacts 200, 300 while keeping the power contacts 200, 300 mated for a sufficient time for electronic components to discharge built-up electric charge.

Figure 15:
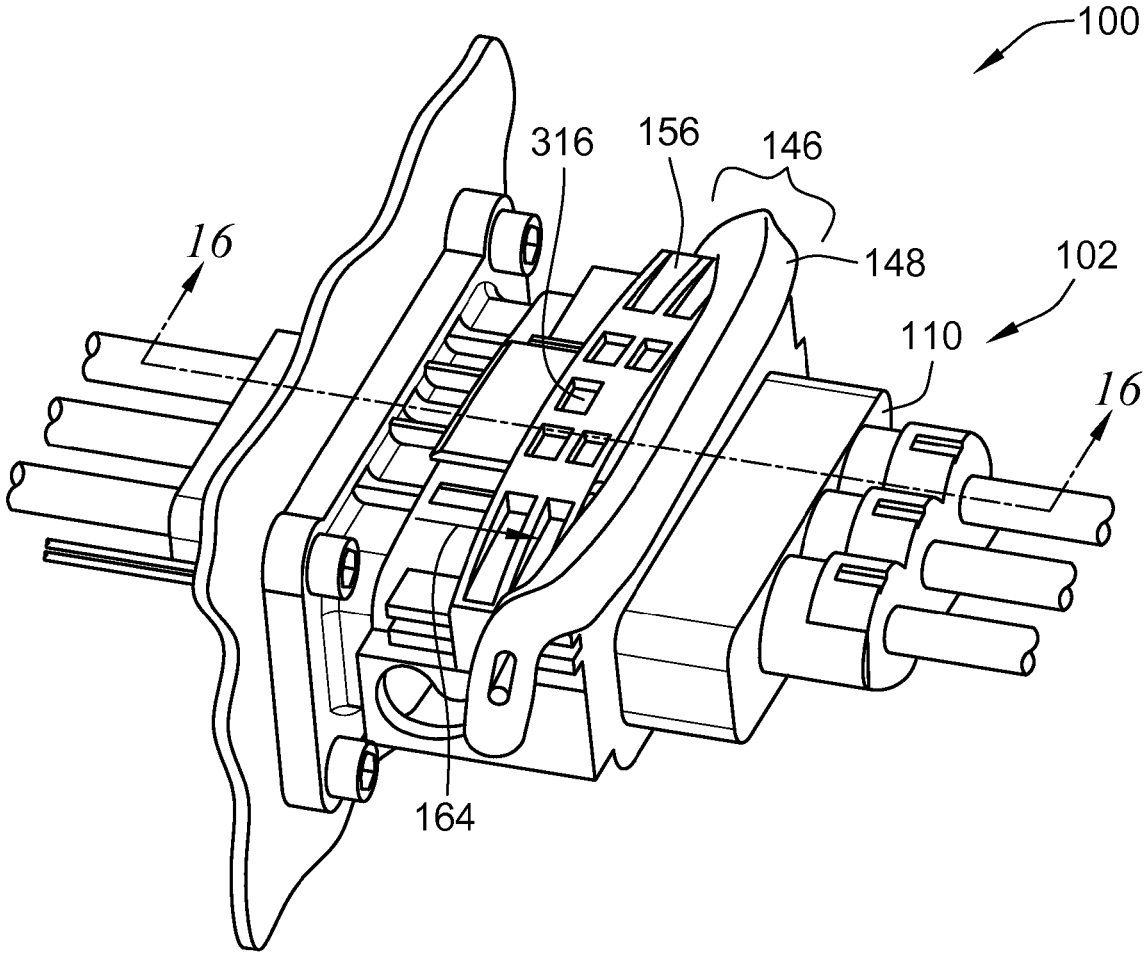
FIG. 15 is a perspective view of the connector assembly shown in FIG. 1 in a second stage of the unmating sequence in accordance with one embodiment of the present disclosure.
Figure 16:
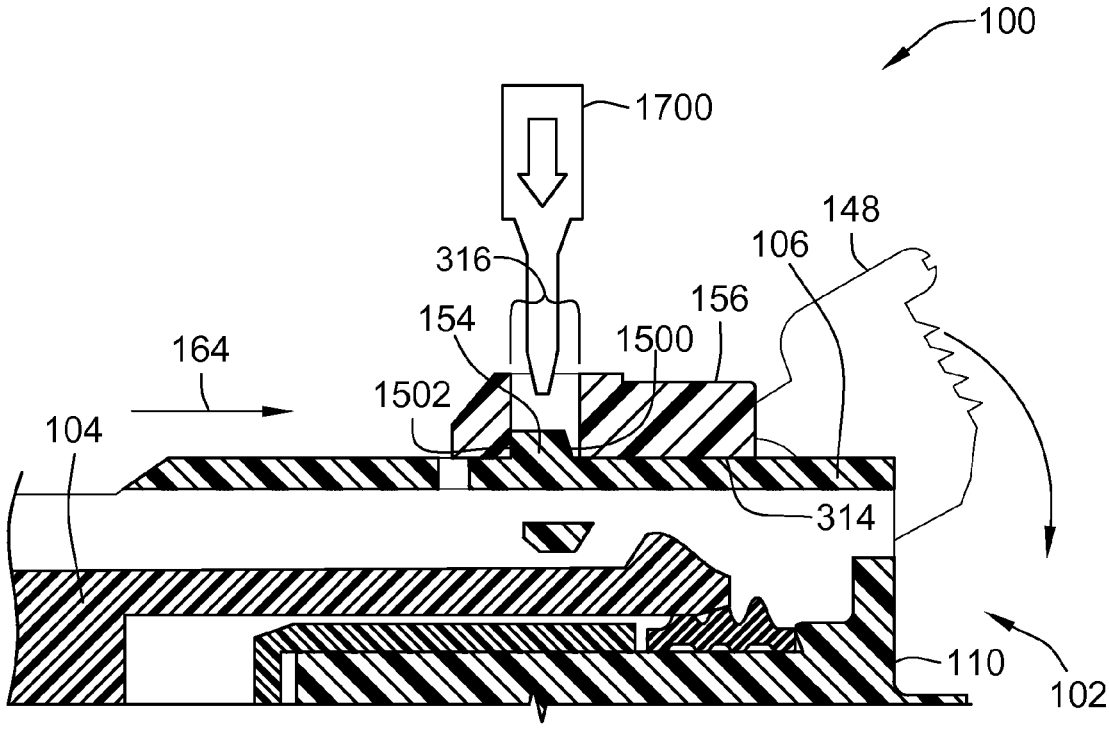
FIG. 16 is a cross-sectional view of the connector assembly shown in FIG. 1 taken along line 16-16 shown in FIG. 15.

FIG. 15 is a perspective view of the connector assembly 100 in a second stage of the unmating sequence in accordance with one embodiment of the present disclosure. FIG. 16 is a cross-sectional view of the connector assembly 100 taken along line 16-16 shown in FIG. 15. After mating the connector assembly 102 with the mating connector assembly 104 (as shown in FIG. 11), the connector assembly 102 may be decoupled from the mating connector assembly 104 by rearwardly rotating the lever subassembly 146. As described above, the rearward rotation of the handle 148 moves the slide bar 156 in the unmating direction 164 and may cause the gripping ends 152 (shown in FIG. 1) to move the connector assembly 102 in the unmating direction 164. For example, the teeth 302 (shown in FIG. 3) of the lever subassembly 146 may rotate in a direction opposite the advancement arc 1100 (shown in FIG. 10) to translate rotation of the handle 148 into linear movement of the connector assembly 102 in the unmating direction 164. As shown in FIG. 15, the handle 148 has been rearwardly rotated toward the rear side 110 of the connector assembly 102 to a middle position. Once the lever latch 154 (shown in FIG. 1) is depressed, the slide bar 156 may move along the unmating direction 164 as the handle 148 is rearwardly rotated. The handle 148 may continue to rotate toward the rear side 110 and the slide bar 156 may slide along the unmating direction 164 until the lever latch 154 rises into the latch opening 316 in the slide bar 156.

For example, as shown in FIG. 16, the latch opening 316 may be aligned with the lever latch 154 such that the lever latch 154 is biased downward by the slide bar 156 until the lever latch 154 springs up into the latch opening 316. The angled surface 1500 of the lever latch 154 permits the slide bar 156 to downwardly bias the lever latch 154 and pass over the lever latch 154 until the lever latch 154 resiliently springs upward into the latch opening 316 when the slide bar 156 moves opposite of the unmating direction 164. For example, the bottom side 314 of the slide bar 156 may depress the lever latch 154 as the slide bar 156 passes over the lever latch 154. Once the latch opening 316 is disposed over the lever latch 154, the lever latch 154 may "pop" upwards to engage the slide bar 156 inside the latch opening 316 to prevent further rearward movement of the slide bar 156. The lever latch 154 engages the slide bar 156 inside the latch opening 316 to prevent continued rearward movement of the slide bar 156 along the unmating direction 164. For example, the blocking surface 1502 of the lever latch 154 engages the slide bar 156 inside the latch opening 316 to stop further movement of the slide bar 156 in the unmating direction 164. As a result, the restricted movement of the slide bar 156 also prevents further rotation of the handle 148 and movement of the connector assembly 102 in the unmating direction 164.

Figure 17:
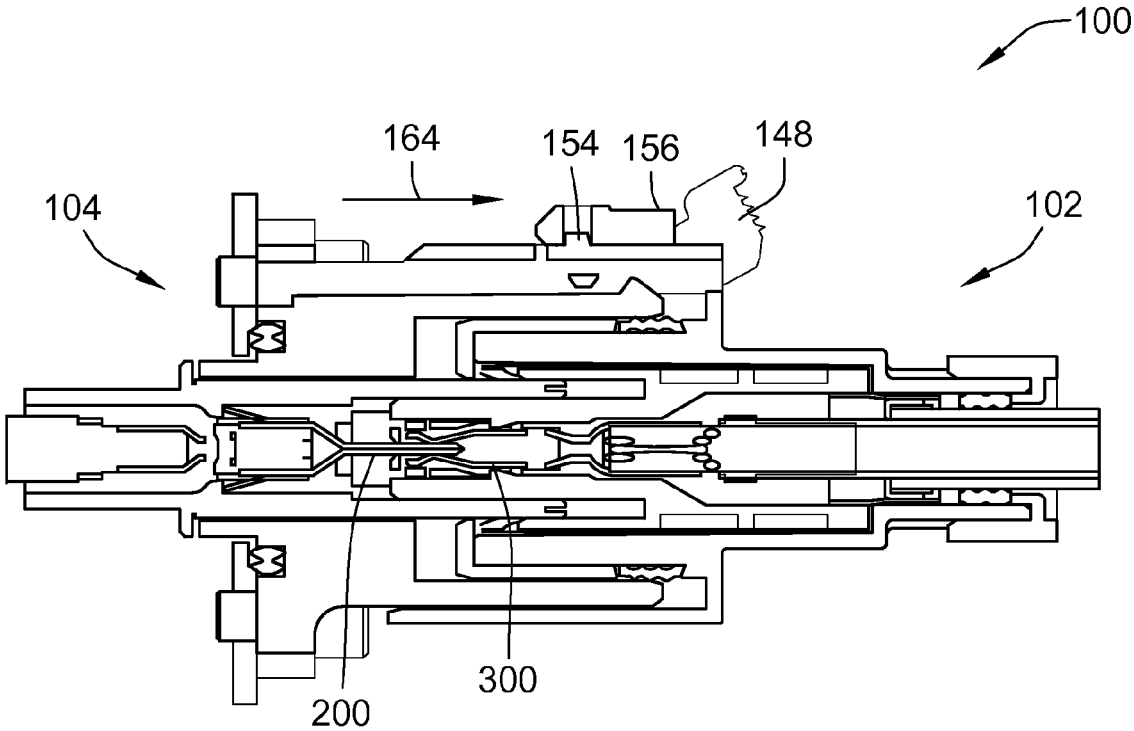
FIG. 17 is a cross-sectional view of the connector assembly shown in FIG. 1 taken along line A-A in the second stage of the unmating sequence as shown in FIG. 15.

FIG. 17 is a cross-sectional view of the connector assembly 100 taken along line A-A in the second stage of the unmating sequence as shown in FIG. 15. The movement of the connector assembly 102 along the unmating direction 164 and away from the mating connector assembly 104 from the first stage (shown in FIG. 11) to the second stage (shown in FIG. 15) of the unmating sequence may preserve the coupling between the power contacts 200, 300. For example, the power contacts 200, 300 may be moved away from one another as the connector assembly 102 moves along the unmating direction 162 relative to the mating connector assembly 104 until the lever latch 154 engages the slide bar 156. As the lever latch 154 prevents further movement of the slide bar 156 and handle 148 away from the mating connector assembly 104, the power contacts 200, 300 also are prevented from being decoupled from one another.

Figure 18:
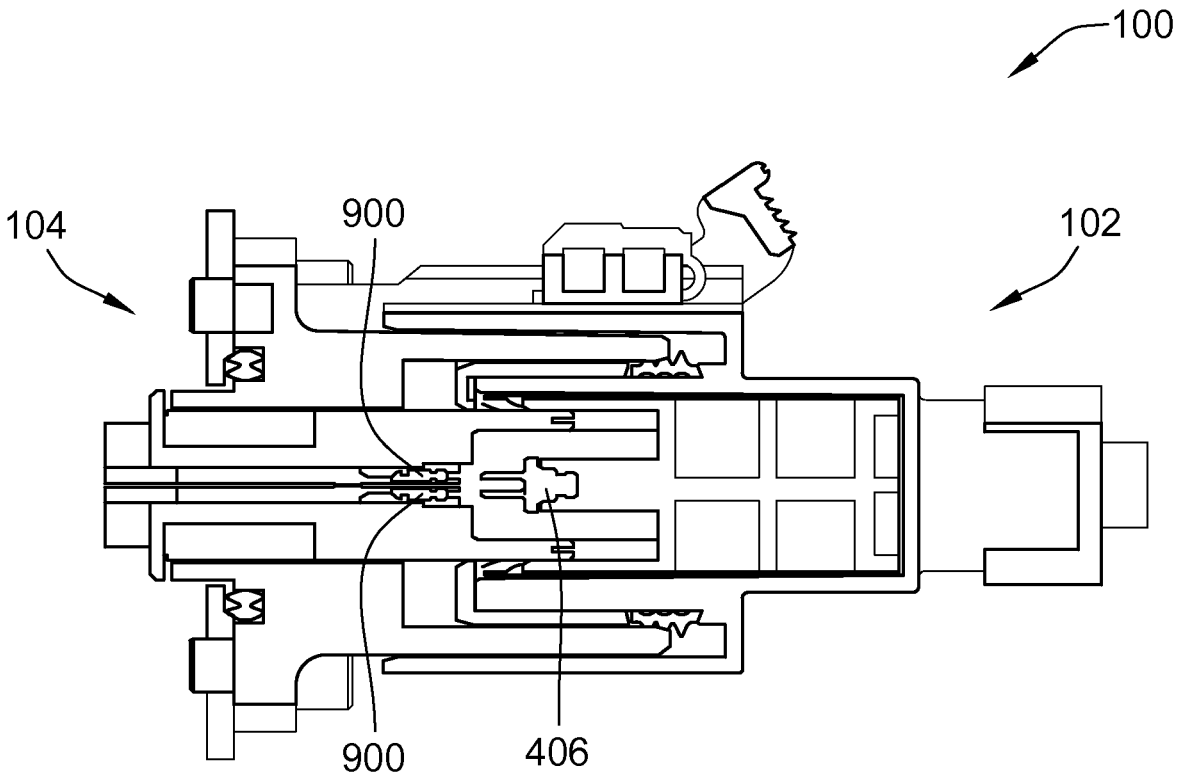
FIG. 18 is a cross-sectional view of the connector assembly shown in FIG. 1 taken along line B-B in the second stage of the unmating sequence as shown in FIG. 15.

FIG. 18 is a cross-sectional view of the connector assembly 100 taken along line B-B in the second stage of the unmating sequence as shown in FIG. 15. The interlock circuit contact 406 of the connector assembly 102 is decoupled from the mating interlock contacts 900 of the mating connector assembly 104 in this stage. As shown in FIG. 17, the power contacts 200, 300 (shown in FIGS. 2 and 3) remain in contact with one another while the interlock contacts 406, 900 are decoupled. The unmating of the interlock contacts 406, 900 may interrupt or stop communication of electric power through the power contacts 200, 300. For example, the HVIL or interlock circuit 2320 (shown in FIG. 23) to which the interlock contacts 406, 900 are joined may detect the unmating of the interlock contacts 406, 900 and stop transfer of electric power through the power supply circuit 2302 (shown in FIG. 23) via the power contacts 200, 300, as described above in the example disclosed in FIG. 23. Keeping the power contacts 200, 300 mated with one another provides a conductive pathway for electric charge or current remaining in one or more components that are electrically coupled with the power contacts 200, 300 to dissipate or discharge the current or charge via the power contacts 200, 300. For example, one or more of the cables 114, 142 (shown in FIG. 1) may be electrically coupled with an electric ground reference. The cables 114, 142 may transfer the current or charge to the ground reference via the mated power contacts 200, 300 after the interlock contacts 406, 900 are decoupled and electric power is no longer transmitted via the power contacts 200, 300.

As shown in FIG. 16, in order to complete decoupling or unmating of the connector assembly 102 from the mating connector assembly 104, a tool 1700, such as a screwdriver, may be used to depress the lever latch 154 and release the slide bar 156 from engagement with the lever latch 154. While a screwdriver is shown as the tool 1700, alternatively a different tool 1700 or object may be used. The tool 1700 is inserted into the latch opening 316 in the slide bar 156. The tool 1700 depresses the lever latch 154 downward into the housing 106 of the connector assembly 102. The tool 1700 downwardly biases the lever latch 154 sufficiently far that the blocking surface 1502 of the lever latch 154 does not block or prevent rearward movement of the slide bar 156 in the unmating direction 164. For example, the lever latch 154 may be pushed downward while the handle 148 is rearwardly rotated toward the rear side 110 of the housing 106. The handle 148 may be permitted to rotate toward the rear side 110 and the slide bar 156 may be able to move in the unmating direction 164 once the lever latch 154 is downwardly biased sufficiently far that the lever latch 154 no longer blocks movement of the slide bar 156 in the unmating direction 164. The slide bar 156 may then move in the unmating direction 164 as the handle 148 is rotated toward the rear side 110 of the housing 106.

The time required for a user or operator of the assembly 100 to insert the tool 1700 into the latch opening 316 and depress the lever latch 154 may be sufficiently long to permit built-up electric charge in components electrically coupled with the power contacts 200, 300 (shown in FIGS. 2 and 3) to discharge via an electric ground reference. For example, the interruption of rearward movement of the slide bar 156 and rearward rotation of the handle 148 caused by the engagement of the lever latch 154 with the slide bar 156 as shown in FIG. 16 and the subsequent time required to disengage the lever latch 154 from the slide bar 156 may be sufficiently long to discharge remaining electric charge or current to a ground reference via the cables 114, 142 (shown in FIG. 1). As the handle 148 continues to rearwardly rotate, the connector assembly 102 continues to move in the unmating direction 164 away from the mating connector assembly 104. This movement of the connector assembly 102 may eventually decouple the power contacts 200, 300 (shown in FIGS. 2 and 3) from one another and the connector assembly 102 from the mating connector assembly 104.

Figure 19:
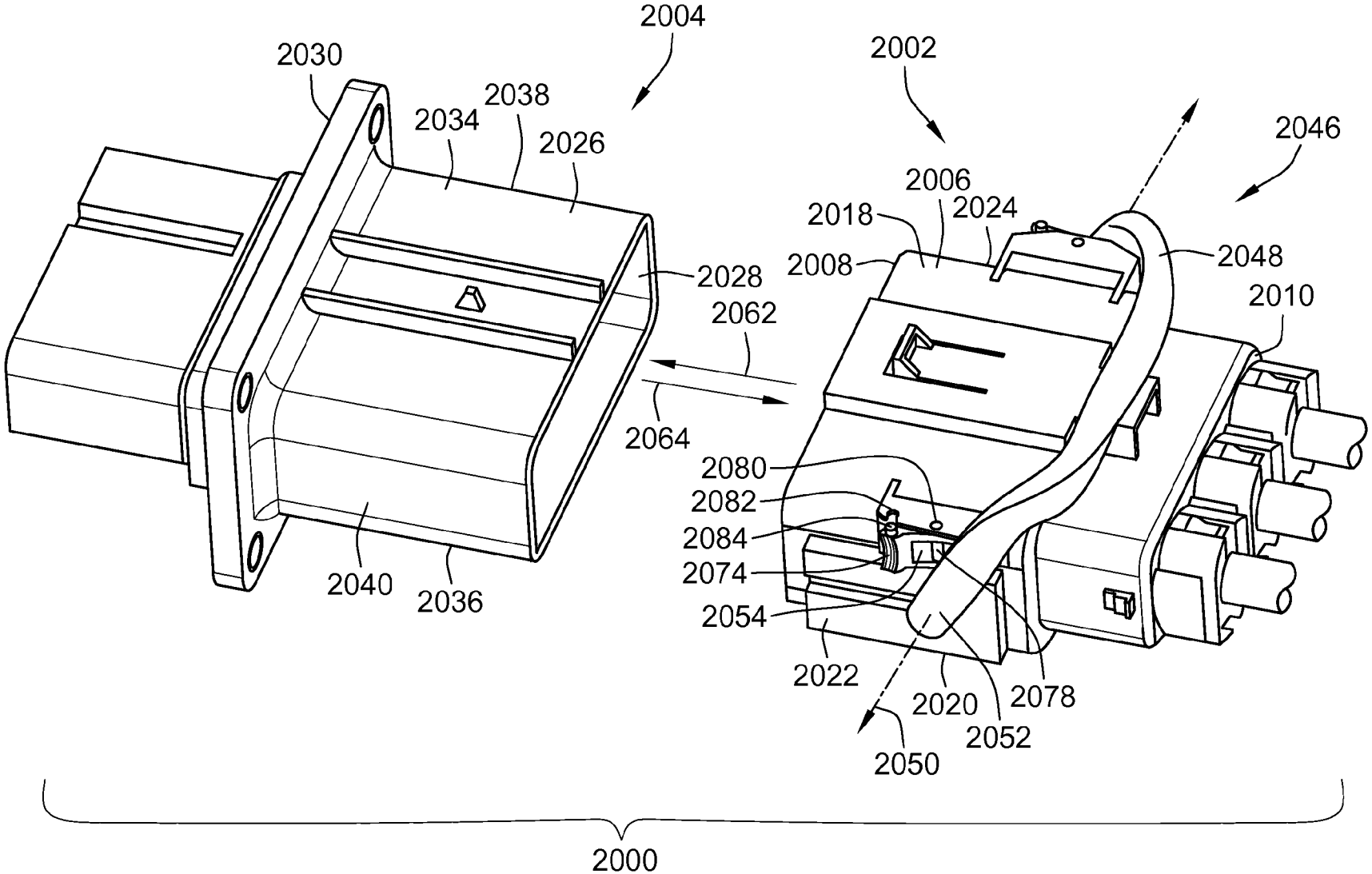
FIG. 19 is a perspective view of an unmated connector assembly in accordance with another embodiment of the present disclosure.

FIG. 19 is a perspective view of an unmated connector assembly 2000 in accordance with another embodiment of the present disclosure. The connector assembly 2000 may be similar to the connector assembly 100 shown in FIG. 1. For example, the connector assembly 2000 may be a high voltage connector assembly that includes a connector assembly 2002 and a mating connector assembly 2004. The connector assembly 2002 may be similar to the connector assembly 102 (shown in FIG. 1) and the mating connector assembly 2004 may be similar to the mating connector assembly 104 (shown in FIG. 1). For example, the connector assembly 2002 and the mating connector assembly 2004 may mate with one another to transfer electric power therebetween.

The connector assembly 2002 includes an outer housing 2006 that longitudinally extends between a mating face 2008 and a rear side 2010, and extends between a top side 2018 and an opposite bottom side 2020, and between opposite sides 2022, 2024. The mating face 2008 engages and mates with the mating connector assembly 2004 to couple the connector assembly 2002 with the mating connector assembly 2004. The mating connector assembly 2004 includes an outer housing 2026 that longitudinally extends between a mating face 2028 and a mounting face 2030. The mating face 2028 mates with the connector assembly 2002 and the mounting face 2030 may be mounted or otherwise coupled with a module such as the module 132 (shown in FIG. 1). The housing 2026 also extends between opposite top and bottom sides 2034, 2036, and between opposite sides 2038, 2040. The connector assembly 2002 and the mating connector assembly 2004 include power contacts and interlock contacts that may be similar or identical to the power contacts 200, 300 (shown in FIGS. 2 and 3) and the interlock contacts 406, 900 (shown in FIGS. 4 and 9).

The connector assembly 2002 includes a lever subassembly 2046 coupled to the housing 2006. The lever subassembly 2046 is manually actuated to move the connector assembly 2002 toward and/or away from the mating connector assembly 2004. The lever subassembly 2046 includes a handle 2048 that is pivotally coupled to the housing 2006 such that the handle 2048 rotates relative to the housing 2006 about a pivot axis 2050. Similar to the handle 148 (shown in FIG. 1), the handle 2048 may rotate in opposite directions from a rearward position to a forward position in order to mate the connector assembly 2002 with the mating connector assembly 2004. The handle 2048 may be rotated in an opposite direction away from the mating connector assembly 2004 to unmate the connector assembly 2002 from the mating connector assembly 2004. The handle 2048 may include gripping ends 2052 that are similar to the gripping ends 152. For example, the gripping ends 2052 may engage the housing 2026 of the mating connector assembly 2004 to translate rotary motion of the handle 2048 into linear movement of the connector assembly 102 relative to the mating connector assembly 2004 along opposite mating and unmating directions 2062, 2064.

One difference between the connector assembly 100 (shown in FIG. 1) and the connector assembly 2000 is the inclusion of lever latches 2054 on the opposite sides 2022, 2024 of the connector assembly 2002. While two lever latches 2054 are shown in FIG. 19, alternatively only a single lever latch 2054 may be provided. The lever latches 2054 engage the lever subassembly 2046 when the handle 2048 is rotated during mating and/or unmating of the connector assembly 2002 and mating connector assembly 2004. The lever latches 2054 are shown as toggle switches that are pivotally coupled with the housing 2006 of the connector assembly 2002. The toggle switches extend between a forward end 2074 and a rearward end 2076 (shown in FIG. 20) with a pivot pin 2078 vertically disposed between the ends 2074, 2076. The pin 2078 is joined to the housing 2006 at or near the opposite ends of the pivot pin 2078 to provide a pivot or rotation axis for the toggle switch. As shown in FIG. 19, the pin 2078 is received in pin openings 2080 in the housing 2006. The ends 2074, 2076 may pivot about the pivot pin 2078 such that the ends 2074, 2076 see-saw relative to one another. For example, the toggle switch that is visible in FIG. 19 may pivot such that when one end 2074 is pivoted or rotated away from the side 2022 of the housing 2006, the other end 2076 is pivoted or rotated toward the side 2022. Conversely, when the end 2074 is pivoted or rotated toward the side 2022, the other end 2076 may pivot or rotate away from the side 2022.

The housing 2006 may include recesses 2082 extending into the housing 2006 that are shaped to receive the ends 2074, 2076. In the illustrated embodiment, the ends 2074, 2076 include nubs or protrusions 2084 that are received into the recesses 2082. The protrusions 2084 may snap into the recesses 2082 and be held in a snap-fit or interference fit engagement with the housing 2006. For example, the ends 2074, 2076 may alternatively pivot toward and away from the housing 2006, with the end 2074, 2076 that pivots toward the housing 2006 being secured to the housing 2006 through an interference fit between the end 2074, 2076 and the corresponding recess 2082. When one end 2074, 2076 of the toggle switch is held by the housing 2006, the other end 2074, 2076 may project sufficiently far from the housing 2006 to impede or prevent rotation of the handle 2048 past the projecting end 2074, 2076. For example, in the embodiment shown in FIG. 19, the end 2074 may prevent rotation of the handle 2048 toward the mating face 2008 and past the end 2074. The end 2074 may prevent rotation of the handle 2048 past the end 2074 until a user or operator of the assembly 2000 depresses the end 2074 to pivot the end 2074 toward the housing 2006 and the end 2076 away from the housing 2006.

The connector assembly 2002 mates with the mating connector assembly 2004 in a multi-stage mating sequence. The mating sequence sequentially mates the power contacts and the interlock circuit contacts in a manner similar to as described above in connection with the connector assembly 100 (shown in FIG. 1). For example, the mating sequence mates the power contacts in the connector assembly 2002 with the power contacts in the mating connector assembly 2004 prior to mating the interlock contacts in the connector assembly 2002 with the interlock contacts in the mating connector assembly 2004. The connector assembly 2002 may decouple from the mating connector assembly 2004 in a multi-stage unmating sequence. Similar to the unmating sequence of the connector assembly 100, the unmating sequence of the assembly 2000 may sequentially decouple the power contacts of the connector assembly 2002 from the power contacts of the mating connector assembly 2004 and the interlock contacts of the connector assembly 2002 from the interlock contacts of the mating connector assembly 2004. For example, the unmating sequence causes the interlock contacts to decouple with one another prior to the unmating of the power contacts, with a sufficient time delay between the unmating of the interlock contacts and the unmating of the power contacts to permit electronic components electrically coupled with the power contacts to discharge built-up electric charge before the power contacts are decoupled.

Figure 20:
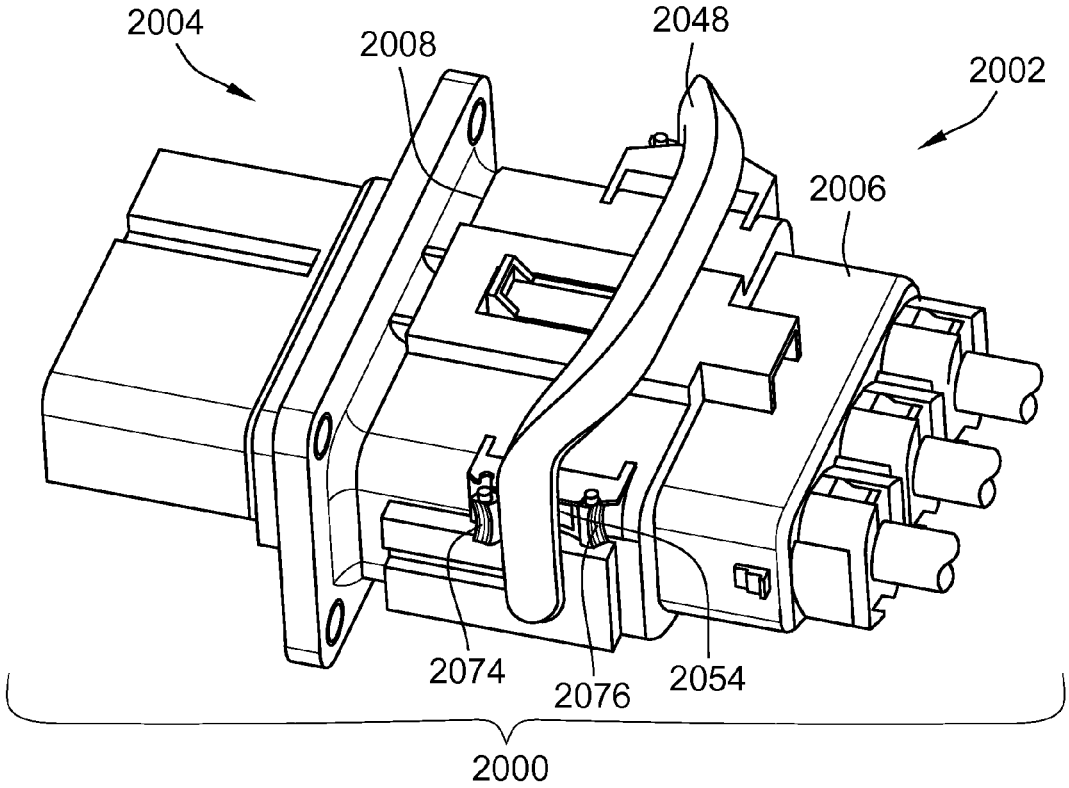
FIG. 20 illustrates a first stage in the mating sequence of the connector assembly shown in FIG. 19 in accordance with one embodiment of the present disclosure.

FIG. 20 illustrates a first stage in the mating sequence of the connector assembly 2000 in accordance with one embodiment of the present disclosure. In the first stage, the mating connector assembly 2004 is received into the connector assembly 2002 until the power contacts of the assemblies 2002, 2004 mate with one another, but prior to the mating of the interlock contacts. The handle 2048 may be forwardly rotated until the handle 2048 engages the end 2074 of the lever latch 2054 and is blocked from being further advanced toward the mating face 2008 of the connector assembly 2002. The lever latch 2054 may then be manually actuated by an operator depressing the end 2074 toward the housing 2006 of the connector assembly 2002 and thereby pivoting the end 2076 away from the housing 2006.

Figure 21:
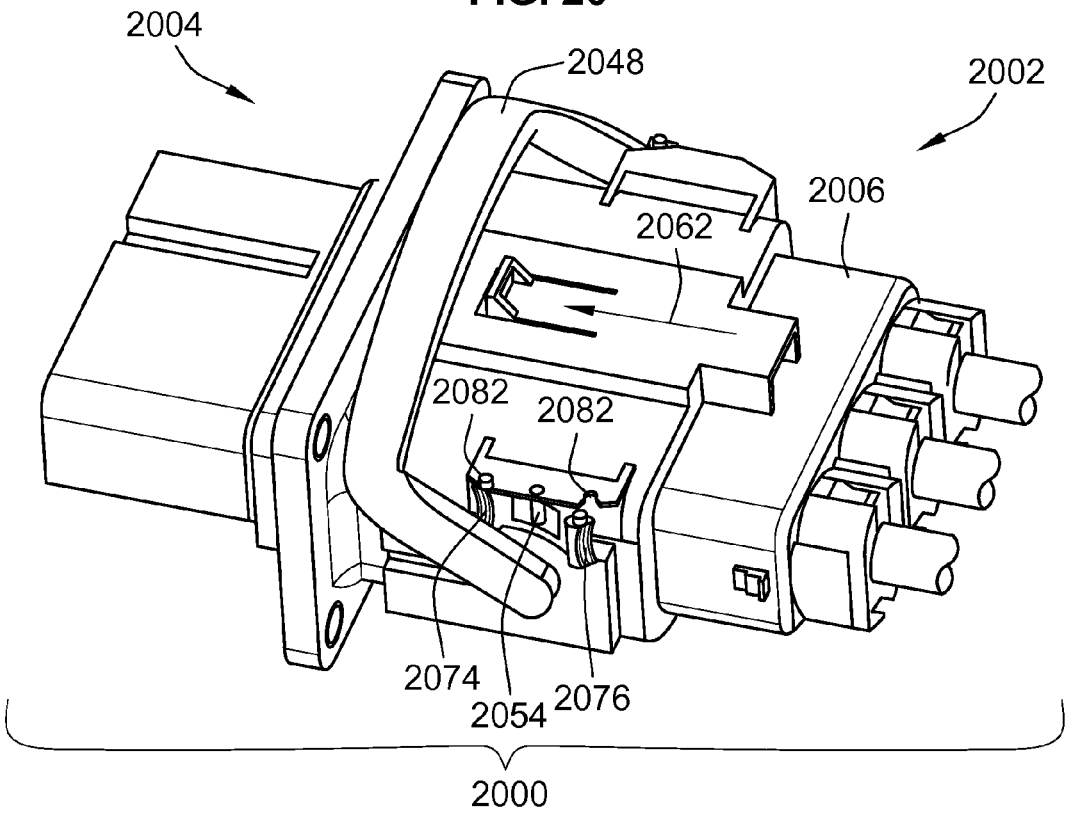
FIG. 21 is a perspective view of a second stage of the mating sequence of the connector assembly shown in FIG. 19 in accordance with one embodiment of the present disclosure.

FIG. 21 is a perspective view of a second stage of the mating sequence of the connector assembly 2000 in accordance with one embodiment of the present disclosure. In the second stage, the forward end 2074 of the lever latch 2054 is pivoted toward the housing 2006 until the forward end 2074 is secured by one or more of the recesses 2082 in the housing 2006 and the rear end 2076 is displaced away from the housing 2006. With the forward end 2074 secured against the housing 2006, the handle 2048 may be rotated to the forward position shown in FIG. 21. In this position, the handle 2048 and the gripping ends 2052 of the handle 2048 have advanced the connector assembly 2002 into a mated relationship with the mating connector assembly 2004. For example, the handle 2048 may advance the connector assembly 2002 along the mating direction 2062 such that the interlock contacts of the connector assembly 2002 and the mating connector assembly 2004 are mated with one another with the power contacts of the connector assembly 2002 and the mating connector assembly 2004 remain mated with one another. As described above, in the mated position shown in FIG. 21, an interlock circuit similar to the HVIL circuit 172 (shown in FIG. 1) may commence transmission of electric power or current through the mated power contacts once the interlock contacts are mated.

As described above, the connector assembly 2002 unmates or is decoupled from the mating connector assembly 2004 in a multi-stage unmating or unmating sequence. The sequence sequentially decouples the power contacts of the connector assembly 2002 from the power contacts of the mating connector assembly 2004 and the interlock contacts of the connector assembly 2002 from the interlock contacts of the mating connector assembly 2004. The unmating sequence introduces a time delay between the unmating of the interlock contacts and the unmating of the power contacts in order to cut off the supply of electric power through the power contacts while keeping the power contacts mated for a sufficient time for electronic components to discharge built-up electric charge.

Figure 22:
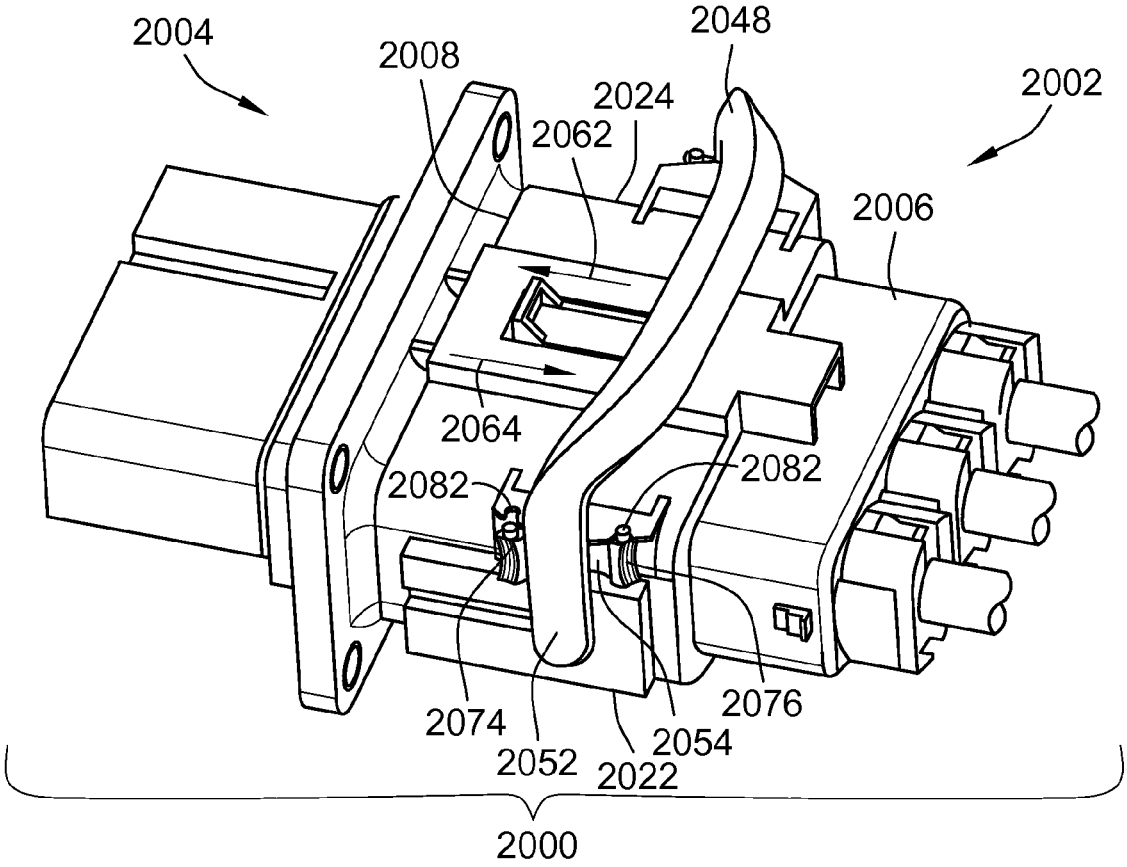
FIG. 22 is a perspective view of the connector assembly shown in FIG. 19 in a second stage of the unmating sequence in accordance with one embodiment of the present disclosure.

FIG. 22 is a perspective view of the connector assembly 2000 in a second stage of the unmating sequence in accordance with one embodiment of the present disclosure. The mated position of the connector assembly 2000 shown in FIG. 21 may be the first stage of the unmating sequence. After mating the connector assembly 2002 with the mating connector assembly 2004, the connector assembly 2002 may be decoupled from the mating connector assembly 2004 by rearwardly rotating the handle 2048. As described above, rotation of the gripping ends 2052 of the handle 2048 when the handle 2048 rotates toward the mating connector assembly 2004 causes the gripping ends 2052 to linearly advance the connector assembly 2002 toward the mating connector assembly 2004 along the mating direction 2062. Conversely, rotation of the gripping ends 2052 when the handle 2048 rotates away from the mating connector assembly 2004 causes the gripping ends 2052 to linearly retreat the connector assembly 2002 away from the mating connector assembly 2004 along an opposite unmating direction 2064.

As shown in FIG. 22, the handle 2048 has been rearwardly rotated away from the mating connector assembly 2004 to a middle position where the handle 2048 is disposed between the ends 2074, 2076 of the lever latch 2054. For example, the handle 2048 may be rearwardly rotated until the handle 2048 engages the rear end 2076 of the lever latch 2054. The rear end 2076 is in a position projected away from the housing 2006 such that the rear end 2076 blocks further rearward rotation of the handle 2048. The securing of the front end 2074 of the lever latch 2054 in one or more of the recesses 2082 may prevent the lever latch 2054 from pivoting the rear end 2076 toward the housing 2006 and out of the way of the handle 2048. The lever latch 2054 may be manually actuated to permit the handle 2048 to be rotated away from the mating connector assembly 2004. For example, the rear end 2076 may be depressed toward the housing 2006 to pivot the lever latch 2054, move the front end 2074 away from the housing 2006, and move the rear end 2076 toward the housing 2006 and out of the way of the handle 2048. Once the rear end 2076 is out of the way, the handle 2048 may continue to be rotated away from the mating face 2008 of the connector assembly 2002.

In one embodiment, the rearward rotation of the handle 2048 from the position shown in FIG. 21 until the handle 2048 is disposed between the ends 2074, 2076 of the lever latch 2054 decouples the interlock contacts of the connector assembly 2002 and the mating connector assembly 2004 but maintains the mating of the power contacts. In order to decouple the power contacts to separate the connector assembly 2002 from the mating connector assembly 2004, the operator or user of the connector assembly 2000 depresses the rear end 2076 of the lever latch 2054 to move the rear end 2076 out of the way of the handle 2048. In one embodiment, the operator depresses the rear ends 2076 of the lever latches 2054 on both sides 2022, 2024 of the housing 2006 to rearwardly rotate the handle 2048 and decouple the power contacts in the connector assembly 2002 and the mating connector assembly 2004.

The time required for the user or operator of the assembly 2000 to toggle the lever latches 2054 such that the rear ends 2076 move toward the housing 2006 and out of an engaged relationship with the handle 2048 may be sufficiently long to permit built-up electric charge in components electrically coupled with the power contacts in the assembly 2000 to discharge via an electric ground reference. For example, the interruption of rearward rotation of the handle 2048 and movement of the connector assembly 2002 in the unmating direction 2064 relative to the mating connector assembly 2004 in combination with the time required to disengage the lever latch 2054 from the handle 2048 may be sufficiently long to discharge remaining electric charge or current to a ground reference. As the handle 2048 continues to rearwardly rotate after the lever latch 2054 toggles out of the way of the handle 2048 on one or both sides 2022, 2024 of the connector assembly 2002, the connector assembly 2002 continues to move in the unmating direction 2064 away from the mating connector assembly 2004. This movement of the connector assembly 2002 may decouple the power contacts in the connector assemblies 2002, 2004 from one another and the connector assembly 2002 from the mating connector assembly 2004.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing having a mating face configured to mate with a mating connector assembly;

a power supply contact disposed within the housing and configured to mate with a mating power contact in the mating connector assembly;

an interlock circuit contact disposed within the housing and configured to mate with a mating interlock contact in the mating connector assembly to control transfer of the electric power through the power supply contact;

a lever subassembly pivotally coupled to the housing and comprising a handle and a gripping end that engages the mating connector to move the housing relative to the mating connector when the handle is rotated, the handle rotated to sequentially unmate the interlock circuit contact from the mating interlock contact prior to unmating the power supply contact from the mating power contact; and a lever latch coupled with the housing, the lever latch preventing unmating of the power supply contact from the mating power contact before separation of the interlock circuit contact and the mating interlock contact before the power supply contact is decoupled from the mating power contact and after the interlock circuit contact is decoupled from the mating interlock contact by blocking rotation of the lever subassembly.

2. The connector assembly of claim 1, wherein the lever latch permits further rotation of the lever subassembly to decouple the power supply contact from the mating power contact after manual actuation of the lever latch.

3. The connector assembly of claim 1, wherein the lever subassembly comprises a slide bar coupled to the handle and slidably joined to the housing such that rotation of the handle moves the slide bar linearly relative to the housing, the lever latch preventing unmating of the power supply contact from the mating power contact before separation of the interlock circuit contact and the mating interlock contact.

4. The connector assembly of claim 1, wherein the lever subassembly comprises a slide bar coupled to the handle and slidably joined to the housing such that rotation of the handle moves the slide bar linearly relative to the housing, the slide bar including a latch that engages the housing and prevents movement of the slide bar toward the mating face of the housing and forward rotation of the lever subassembly.

5. The connector assembly of claim 4, wherein the latch disengages the housing when actuated by the mating connector when the housing mates with the mating connector.

6. The connector assembly of claim 1, wherein the lever subassembly comprises a slide bar coupled to the handle and slidably joined to the housing such that rotation of the handle moves the slide bar linearly relative to the housing, further wherein the slide bar or the handle includes a pin and the other of the slide bar and the handle includes a slot that receives the pin, further wherein movement of the pin within the slot translates rotation of the handle to linear movement of the slide bar.

7. The connector assembly of claim 1, wherein the lever latch comprises a toggle switch pivotally coupled to the housing, the toggle switch extending between opposite forward and rearward ends and including a pivot axis disposed therebetween, the forward and rearward ends alternatively moving toward and away from the housing as the toggle switch pivots about the pivot axis.

8. The connector assembly of claim 7, wherein the rearward end of the toggle switch pivots away from the housing when the lever subassembly is rotated toward the mating face of the housing, the rearward end blocking rearward rotation of the lever subassembly until the manual actuation depresses the rearward end toward the housing and pivots the forward end away from the housing.

9. The connector assembly of claim 1, wherein rotation of the lever subassembly toward the mating face mates the housing with the mating connector and sequentially mates the power supply contact with the mating power contact prior to mating the interlock circuit contact with the mating interlock contact.

10. The connector assembly of claim 1, wherein the lever latch engages the lever subassembly and prevents movement of the lever subassembly away from the mating face of the housing when the housing mates with the mating connector.

11. A connector assembly comprising:

a housing having a mating face configured to mate with a mating connector;

a power supply contact disposed within the housing and configured to mate with a mating power contact in the mating connector;

an interlock circuit contact disposed within the housing and configured to mate with a mating interlock contact in the mating connector to control transfer of the electric power through the power supply contact;

a lever subassembly pivotally coupled to the housing, the lever subassembly comprising a handle and a gripping end that engages the mating connector to move the housing relative to the mating connector when the handle is rotated, the handle rotated away from the mating face to sequentially unmate the interlock circuit contact from the mating interlock contact prior to unmating the power supply contact from the mating power contact; and a slide bar coupled to the handle and slidably joined to the housing such that rotation of the handle linearly moves the slide bar relative to the housing, the slide bar preventing unmating of the power supply contact from the mating power contact before separation of the interlock circuit contact and the mating interlock before the power supply contact is unmated from the mating power contact and after the interlock circuit contact is unmated from the mating interlock contact.

12. The connector assembly of claim 11, wherein the housing includes a latch that engages the slide bar and stops movement of the slide bar to block rotation of the lever subassembly, the slide bar permitting further rotation of the handle to unmate the power supply contact from the mating power contact after manual actuation of the latch.

13. The connector assembly of claim 11, wherein the slide bar includes a latch that engages the housing and prevents movement of the slide bar toward the mating face of the housing and forward rotation of the lever subassembly.

14. The connector assembly of claim 11, wherein the handle or the slide bar includes a slot and the other of the handle and the slide bar includes a pin received in the slot, further wherein movement of the pin within the slot translates rotation of the handle to linear movement of the slide bar.

15. The connector assembly of claim 11, wherein the housing includes a latch that engages the slide bar when the lever subassembly is forwardly rotated, the latch blocking rearward movement of the slide bar and rotation of the lever subassembly.

16. A connector assembly comprising:

a housing having a mating face configured to mate with a mating connector;

a power supply contact disposed within the housing and configured to mate with a mating power contact in the mating connector;

an interlock circuit contact disposed within the housing and configured to mate with a mating interlock contact in the mating connector to control transfer of the electric power through the power supply contact;

a lever subassembly pivotally coupled to the housing, the lever subassembly comprising a handle and a gripping end that engages the mating connector to move the housing relative to the mating connector when the handle is rotated, the handle rotated away from the mating face to sequentially unmate the interlock circuit contact from the mating interlock contact prior to unmating the power supply contact from the mating power contact; and a toggle switch pivotally coupled with the housing, the toggle switch preventing unmating of the power supply contact from the mating power contact before separation of the interlock circuit contact and the mating interlock contact before the power supply contact is unmated from the mating power contact and after the interlock circuit contact is unmated from the mating interlock contact.

17. The connector assembly of claim 16, wherein the toggle switch permits further rotation of the handle to unmate the power supply contact from the mating power contact after manual actuation of the toggle switch.

18. The connector assembly of claim 16, wherein the toggle switch extends between opposite forward and rearward ends and includes a pivot axis disposed therebetween, the forward and rearward ends alternatively moving toward and away from the housing as the toggle switch pivots about the pivot axis.

19. The connector assembly of claim 18, wherein the rearward end of the toggle switch pivots away from the housing when the lever subassembly is rotated toward the mating face of the housing, the rearward end blocking rearward rotation of the lever subassembly until the manual actuation depresses the rearward end toward the housing and pivots the forward end away from the housing.

20. The connector assembly of claim 16, wherein the toggle switch engages and blocks rearward rotation of the lever subassembly relative to the housing when the handle is rotated to unmate the housing from the mating connector.

* * * * *